US010431050B2

(12) United States Patent
Brown

(10) Patent No.: US 10,431,050 B2
(45) Date of Patent: Oct. 1, 2019

(54) GAMING SYSTEM AND METHOD PROVIDING A MULTI-HAND CARD GAME WITH MODIFIERS AVAILABLE BASED ON THE INITIALLY-DEALT CARDS OF THE HANDS

(71) Applicant: IGT, Las Vegas, NV (US)

(72) Inventor: Bradford Brown, Sparks, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 15/487,969

(22) Filed: Apr. 14, 2017

(65) Prior Publication Data

US 2017/0323532 A1 Nov. 9, 2017

Related U.S. Application Data

(60) Provisional application No. 62/331,178, filed on May 3, 2016.

(51) Int. Cl.
*G07F 17/32* (2006.01)

(52) U.S. Cl.
CPC ..... *G07F 17/3293* (2013.01); *G07F 17/3246* (2013.01); *G07F 17/3248* (2013.01); *G07F 17/3251* (2013.01); *G07F 17/3262* (2013.01); *G07F 17/3267* (2013.01)

(58) Field of Classification Search
CPC ..... G07F 17/3293
See application file for complete search history.

(56) References Cited

U.S. PATENT DOCUMENTS 5,042,818 A * 8/1991 Weingardt ..... A63F 3/00157 273/274
5,100,137 A 3/1992 Fulton
5,167,413 A 12/1992 Fulton
5,251,897 A 10/1993 Fulton
5,322,295 A 6/1994 Cabot et al.
5,374,067 A 12/1994 Jones
5,411,257 A 5/1995 Fulton
5,431,408 A 7/1995 Adams
5,437,451 A 8/1995 Fulton
5,531,448 A 7/1996 Moody
(Continued)

FOREIGN PATENT DOCUMENTS

GB 2393018 A * 3/2004 ..... G07F 17/3244

*Primary Examiner* — Steven J Hylinski
(74) *Attorney, Agent, or Firm* — Neal, Gerber & Eisenberg LLP

(57) ABSTRACT

Various embodiments of the present disclosure are directed to a gaming system and method providing a multi-hand card game with modifiers available based on initially-dealt cards of the hands. Generally, for a play of the card game, the gaming system randomly determines two or more initial hands of cards and displays at least one card of each initial hand face-up. The gaming system determines, for each initial hand, whether a modifier triggering event occurred for that initial hand based on one or more of the cards of that initial hand. For a given initial hand, if the gaming system determines that the modifier triggering event occurred for that initial hand, the gaming system associates a modifier with that initial hand. The gaming system then finalizes each initial hand and determines any award associated with each finalized initial hand based on the cards of that initial hand and any associated modifier.

14 Claims, 12 Drawing Sheets

(56) References Cited

U.S. PATENT DOCUMENTS 5,542,669 A * 8/1996 Charron ..... G07F 17/3244 463/13
5,636,842 A 6/1997 Cabot et al.
5,732,950 A 3/1998 Moody
5,755,621 A 5/1998 Marks et al.
5,803,809 A 9/1998 Yoseloff
5,820,460 A 10/1998 Fulton
5,823,873 A 10/1998 Moody
5,833,536 A 11/1998 Davids et al.
5,833,537 A 11/1998 Barrie
5,882,259 A 3/1999 Holmes, Jr. et al.
5,911,418 A 6/1999 Adams
5,954,335 A 9/1999 Moody
5,957,774 A 9/1999 Holmes, Jr. et al.
6,007,066 A 12/1999 Moody
6,050,658 A 4/2000 O'Sullivan et al.
6,062,979 A 5/2000 Inoue
6,098,985 A 8/2000 Moody
6,176,781 B1 1/2001 Walker et al.
6,179,711 B1 1/2001 Yoseloff
6,193,235 B1 2/2001 Vancura et al.
6,196,547 B1 3/2001 Pascal et al.
6,210,276 B1 * 4/2001 Mullins ..... A63F 3/00157 463/17
6,213,877 B1 4/2001 Walker et al.
6,248,016 B1 6/2001 Walker et al.
6,257,979 B1 7/2001 Walker et al.
6,311,978 B1 11/2001 Moody
6,328,649 B1 12/2001 Randall et al.
6,332,614 B1 * 12/2001 Hesse ..... A63F 1/00 273/274
6,334,613 B1 1/2002 Yoseloff
6,406,023 B1 6/2002 Rowe
6,419,578 B1 * 7/2002 Moody ..... G07F 17/32 273/274
6,422,940 B1 7/2002 Walker et al.
6,439,993 B1 * 8/2002 O'Halloran ..... G07F 17/3265 273/143 R
6,454,651 B1 9/2002 Yoseloff
6,471,208 B2 10/2002 Yoseloff et al.
6,474,645 B2 11/2002 Tarantino
6,517,074 B1 2/2003 Moody et al.
6,523,829 B1 2/2003 Walker et al.
6,561,898 B2 5/2003 Moody
6,568,680 B1 5/2003 Moody et al.
6,569,015 B1 5/2003 Baerlocher et al.
6,652,377 B1 11/2003 Moody
6,672,959 B2 * 1/2004 Moody ..... A63F 1/00 273/138.2
6,726,427 B2 4/2004 Jarvis et al.
6,726,563 B1 4/2004 Baerlocher et al.
6,729,961 B1 5/2004 Millerschone
6,916,245 B1 7/2005 Vancura et al.
6,935,950 B2 8/2005 Tarantino
6,955,356 B2 10/2005 Moody
6,964,418 B2 11/2005 Moody
6,991,538 B2 1/2006 Cannon
6,994,624 B2 2/2006 Gold et al.
7,037,190 B2 * 5/2006 Moody ..... G07F 17/32 273/274
7,056,207 B2 6/2006 Walker et al.
7,059,604 B1 * 6/2006 Richards ..... A63F 1/00 273/292
7,059,965 B2 6/2006 Jackson
7,137,628 B2 * 11/2006 Moody ..... A63F 3/00157 273/292
7,156,397 B2 * 1/2007 Moody ..... G07F 17/32 273/143 R
7,156,734 B1 1/2007 Walker et al.
7,201,655 B2 4/2007 Walker et al.
7,247,092 B2 7/2007 Jarvis et al.
7,258,611 B2 8/2007 Bigelow, Jr. et al.
7,297,057 B2 11/2007 Gerrard et al.
7,306,518 B2 12/2007 Hughs-Baird et al.
7,316,608 B2 * 1/2008 Moody ..... A63F 3/00157 463/13
7,331,863 B2 2/2008 Baerlocher
7,338,370 B2 3/2008 Oles et al.
7,354,344 B2 4/2008 Paulsen et al.
7,390,258 B2 6/2008 Millerschone
7,416,186 B2 8/2008 Walker et al.
7,419,162 B2 9/2008 Lancaster et al.
7,488,251 B2 2/2009 Kaminkow
7,524,243 B2 4/2009 Bansemer et al.
7,566,271 B2 7/2009 Hostetler et al.
7,614,946 B2 11/2009 Nicely
7,641,197 B2 1/2010 Jackson
7,658,672 B1 2/2010 Wolf et al.
7,674,180 B2 3/2010 Graham et al.
7,748,714 B2 7/2010 Nicely et al.
7,749,059 B2 7/2010 Tarantino
7,771,274 B2 8/2010 Walker et al.
7,785,188 B2 8/2010 Cannon
7,789,755 B2 9/2010 Davis et al.
7,803,041 B2 9/2010 Gold et al.
7,803,043 B2 9/2010 Jackson
7,815,500 B2 10/2010 Montross et al.
7,837,545 B2 11/2010 Blair, Jr. et al.
7,857,693 B1 12/2010 Johnson et al.
7,862,417 B2 1/2011 Nicely
7,862,430 B2 1/2011 Baerlocher et al.
7,867,073 B2 1/2011 Walker et al.
7,914,369 B2 3/2011 Walker et al.
7,918,724 B2 4/2011 Walker et al.
7,922,571 B2 4/2011 Walker et al.
7,985,133 B2 7/2011 Baerlocher et al.
7,993,191 B2 8/2011 Evans et al.
8,002,620 B2 8/2011 Nicely et al.
8,062,119 B2 11/2011 Stern et al.
8,083,578 B2 12/2011 Jackson
8,092,290 B2 1/2012 Darby
8,092,302 B2 1/2012 Cuddy et al.
8,118,662 B2 2/2012 Caputo et al.
8,123,604 B2 2/2012 Lancaster et al.
8,137,174 B2 3/2012 Nicely et al.
8,152,616 B2 4/2012 Moody
8,152,630 B2 4/2012 Cohen
8,177,616 B2 5/2012 Nicely
8,177,620 B2 5/2012 Miles et al.
8,197,319 B2 6/2012 Nicely
8,216,039 B2 7/2012 Nicely et al.
8,226,469 B2 7/2012 Pawloski et al.
8,231,454 B2 7/2012 Caputo
8,235,780 B2 8/2012 Nicely
8,235,781 B2 * 8/2012 Moody ..... G07F 17/3293 273/138.2
8,262,448 B2 9/2012 Nicely et al.
8,262,455 B2 9/2012 Caputo et al.
8,277,305 B2 10/2012 Caputo et al.
8,328,614 B2 12/2012 Jones et al.
8,353,751 B2 1/2013 Bickley et al.
8,376,836 B2 2/2013 Baerlocher et al.
8,382,572 B2 2/2013 Hoffman et al.
8,398,473 B2 3/2013 Baerlocher et al.
8,408,984 B2 4/2013 Walker et al.
8,419,518 B2 4/2013 Jarvis et al.
8,425,303 B2 4/2013 Kennedy et al.
8,434,764 B2 5/2013 Walker et al.
8,444,465 B2 5/2013 Macaulay
8,449,362 B2 5/2013 Jackson
8,449,363 B2 5/2013 Baerlocher et al.
8,449,378 B2 5/2013 Michaelson et al.
8,475,253 B1 7/2013 Cole
8,491,381 B2 7/2013 Nicely et al.
8,506,388 B2 8/2013 Walker et al.
8,517,818 B2 8/2013 Nicely et al.
8,550,892 B2 10/2013 Moody
8,672,736 B1 3/2014 Nicely
8,690,659 B2 4/2014 Moody
9,011,225 B2 4/2015 Brown et al.
9,011,226 B2 4/2015 Montano
9,129,486 B2 9/2015 Nicely et al.
9,138,634 B2 9/2015 Moody

(56) References Cited

U.S. PATENT DOCUMENTS 9,472,063 B2 10/2016 Nicely et al.
9,524,614 B2 12/2016 Caputo et al.
9,542,814 B2 1/2017 Daniels
9,547,958 B2 1/2017 Cole et al.
9,659,456 B2 * 5/2017 Van Linden ..... G07F 17/3265
2003/0032469 A1 * 2/2003 Moody ..... A63F 1/00 463/13
2004/0097280 A1 * 5/2004 Gauselmann ..... G07F 17/3239 463/16
2004/0248641 A1 * 12/2004 Jarvis ..... G07F 17/32 463/20
2005/0054420 A1 * 3/2005 Cregan ..... G07F 17/3265 463/20
2005/0170876 A1 8/2005 Masci et al.
2005/0239545 A1 * 10/2005 Rowe ..... G07F 17/32 463/29
2006/0046852 A1 * 3/2006 Rowe ..... G07F 17/32 463/42
2006/0089850 A1 * 4/2006 Ko ..... A63F 3/00157 273/303
2006/0128456 A1 * 6/2006 Berman ..... G07F 17/3244 463/13
2006/0211468 A1 * 9/2006 Flint ..... G07F 17/3211 463/16
2006/0281525 A1 * 12/2006 Borissov ..... G07F 17/3265 463/20
2007/0026933 A1 * 2/2007 Tanimura ..... G07F 17/32 463/20
2007/0132183 A1 * 6/2007 Moses ..... A63F 3/00157 273/292
2007/0287529 A1 * 12/2007 Kojima ..... G07F 17/32 463/20
2008/0076542 A1 3/2008 Iddings et al.
2008/0111309 A1 5/2008 Nicely et al.
2008/0146305 A1 * 6/2008 Moody ..... G07F 17/32 463/13
2009/0069071 A1 * 3/2009 Aoki ..... G07F 17/34 463/20
2009/0170582 A1 * 7/2009 Hall ..... G07F 17/32 463/12
2009/0305769 A1 * 12/2009 Plowman ..... G07F 17/32 463/20
2009/0305770 A1 * 12/2009 Bennett ..... G07F 17/32 463/20
2010/0004051 A1 1/2010 Walker et al.
2010/0081497 A1 4/2010 Wolf et al.
2010/0099480 A1 4/2010 Caputo
2010/0113122 A1 5/2010 Walker et al.
2010/0120484 A1 5/2010 Caputo et al.
2010/0137056 A1 6/2010 Hoffman et al.
2011/0003627 A1 1/2011 Nicely et al.
2011/0059790 A1 3/2011 Slomiany et al.
2011/0111818 A1 5/2011 Baerlocher
2011/0114963 A1 5/2011 Son et al.
2011/0117987 A1 * 5/2011 Aoki ..... G07F 17/32 463/20
2012/0122547 A1 * 5/2012 Aoki ..... G07F 17/34 463/20
2012/0214580 A1 8/2012 Hoffman et al.
2012/0295683 A1 11/2012 Moody
2013/0023329 A1 * 1/2013 Saunders ..... G07F 17/34 463/20
2013/0065669 A1 3/2013 Michaelson et al.
2013/0072282 A1 3/2013 Nicely
2013/0079110 A1 3/2013 Nicely et al.
2013/0079123 A1 3/2013 Nicely et al.
2013/0084961 A1 4/2013 Radisich et al.
2013/0137495 A1 * 5/2013 Moody ..... G07F 17/32 463/13
2013/0157733 A1 * 6/2013 Thorne ..... G07F 17/3227 463/1
2013/0260869 A1 10/2013 Basallo et al.
2014/0018146 A1 1/2014 Zielinski et al.
2014/0148231 A1 * 5/2014 Berman ..... A63F 9/24 463/13
2017/0061742 A1 3/2017 Moody, Jr.

* cited by examiner

1000

GAMING SYSTEM AND METHOD PROVIDING A MULTI-HAND CARD GAME WITH MODIFIERS AVAILABLE BASED ON THE INITIALLY-DEALT CARDS OF THE HANDS

PRIORITY CLAIM

This patent application claims priority to and the benefit of U.S. Provisional Patent Application No. 62/331,178, which was filed on May 3, 2016, the entire contents of which are incorporated herein by reference.

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the U.S. Patent and Trademark Office patent file or records, but otherwise reserves all copyright rights whatsoever.

BACKGROUND

Video poker has become very popular. One of the most common variations of video poker is Five Card Draw Poker. In general, for a play of a Five Card Draw Poker game, a gaming system deals a player a hand of five cards face up from a 52 card deck of playing cards. The gaming system enables the player to discard none of, one of, a plurality of but less than all of, or all of the five cards from the player's hand. The gaming system replaces each discarded card with another card from the deck. After replacing any discarded cards, the gaming system evaluates the cards of the player's hand against a paytable to determine whether the player's hand forms a winning hand associated with one of a plurality of different winning hand categories.

SUMMARY

Various embodiments of the present disclosure are directed to a gaming system and method providing a multi-hand card game with modifiers available based on the initially-dealt cards of the hands.

Generally, for a play of the card game in various embodiments, the gaming system randomly determines two or more initial hands of cards and displays at least one card of each initial hand face-up. The gaming system determines, for each initial hand, whether a modifier triggering event occurred for that initial hand based on one or more of the cards of that initial hand. For a given initial hand, if the gaming system determines that the modifier triggering event occurred for that initial hand, the gaming system associates a modifier with that initial hand. The gaming system then finalizes each initial hand and determines any award associated with each finalized initial hand based on the cards of that initial hand and any associated modifier.

More specifically, in one embodiment, the gaming system randomly determines two or more hands of cards and, for each hand, displays a first subset of the cards of that hand face-up and a second subset of the cards of that hand face-down. The gaming system determines, for each first subset of face-up cards, whether the modifier triggering event occurred for that first subset based on the face-up cards of that first subset. For a given first subset, if the gaming system determines that the modifier triggering event occurred for that first subset, the gaming system associates a modifier with that first subset. The gaming system receives a selection of one of the first subsets of face-up cards to hold, and discards each other first subset to create one or more incomplete hands. The gaming system does not discard any modifiers associated with the discarded first subsets, and instead associates each of these modifiers with one of the incomplete hands.

The gaming system enables the player to hold each of the face-up cards in the held first subset. For each card of the held first subset that is not held, the gaming system randomly selects a replacement card and replaces that non-held card with that replacement card. After replacing any non-held cards, the gaming system completes the one or more incomplete hands by adding the first subset to each incomplete hand. For each hand, the gaming system reveals the second subset of the cards of that hand. The gaming system then determines any award associated with each hand based on the cards of that hand and any associated modifier.

Additional features and advantages are described herein, and will be apparent from, the following Detailed Description and the Figures.

DETAILED DESCRIPTION

Providing a Multi-Hand Card Game with Modifiers Available Based on the Initially-Dealt Cards of the Hands Various embodiments of the present disclosure are directed to a gaming system and method providing a multi-hand card game with modifiers available based on the initially-dealt cards of the hands. Generally, for a play of the card game, the gaming system randomly determines two or more initial hands of cards and displays at least one card of each initial hand face-up. The gaming system determines, for each initial hand, whether a modifier triggering event occurred for that initial hand based on one or more of the cards of that initial hand. For a given initial hand, if the gaming system determines that the modifier triggering event occurred for that initial hand, the gaming system associates a modifier with that initial hand. The gaming system then finalizes each initial hand and determines any award associated with each finalized initial hand based on the cards of that initial hand and any associated modifier.

1. Example Method

Figure 1A:
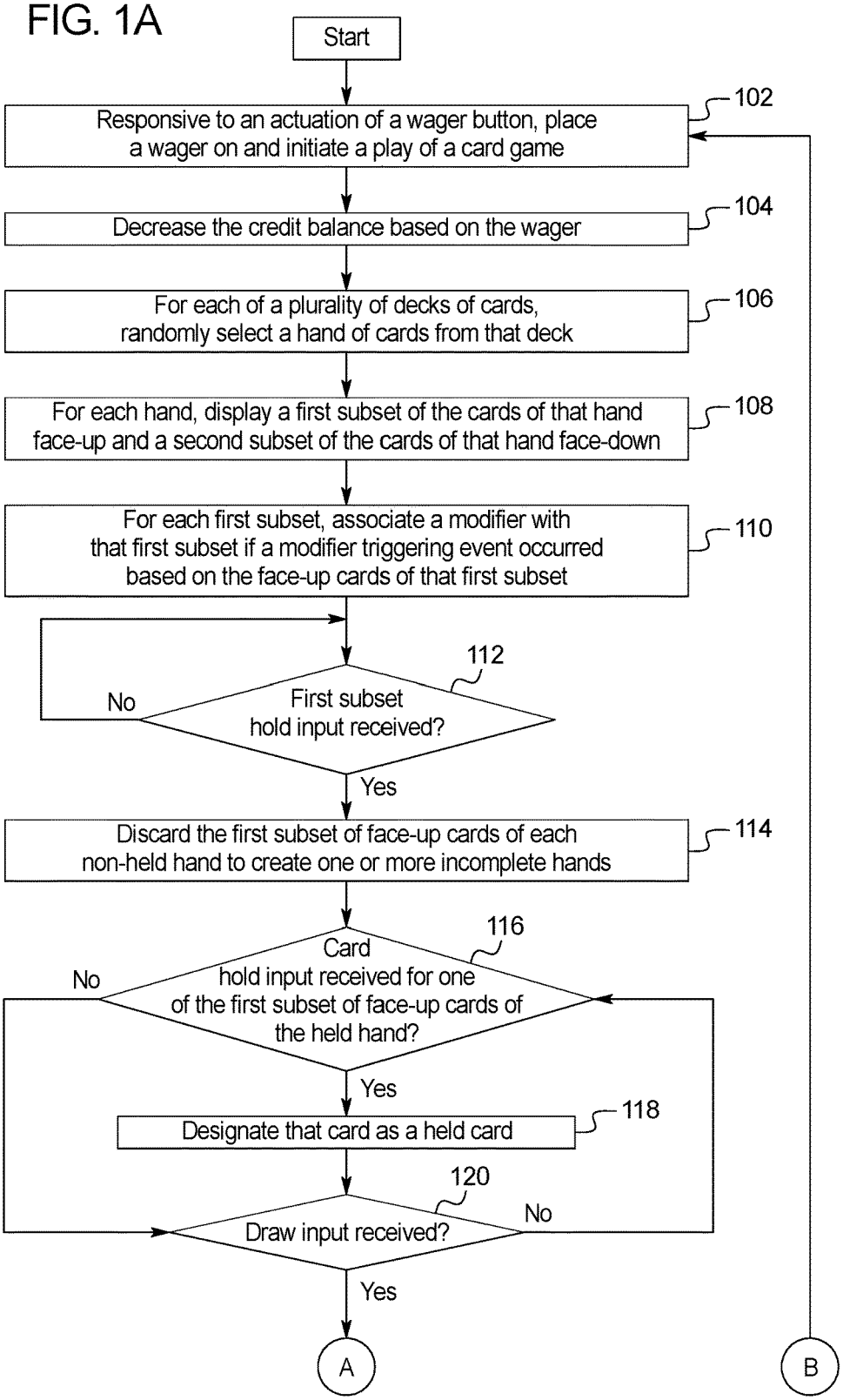
FIGS. 1A and 1B are a flowchart of an example process or method of operating a gaming system of the present disclosure to provide an example multi-hand card game with modifiers available based on the initially-dealt cards of the hands.
Figure 1B:
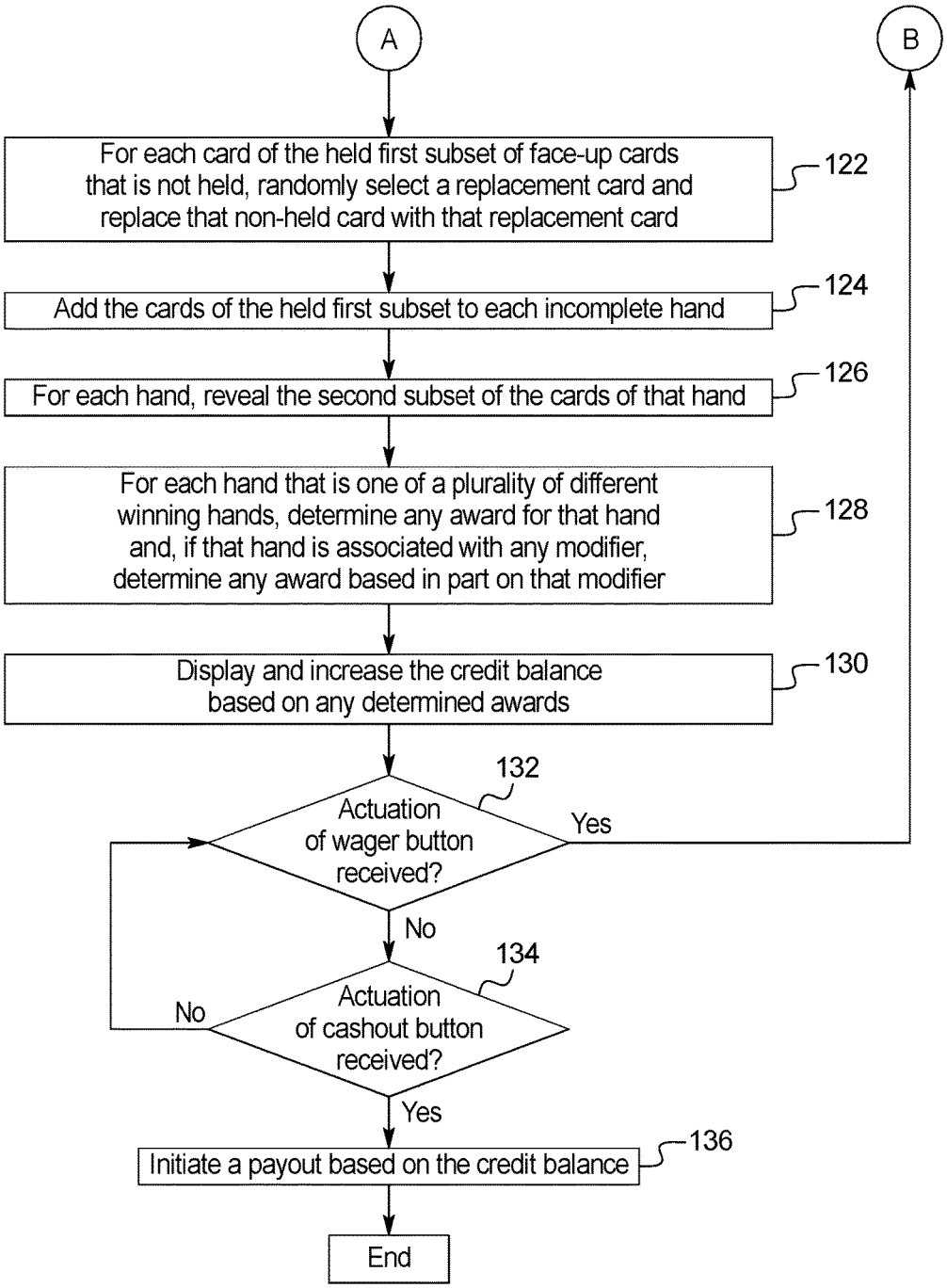

FIG. 1 is a flowchart of an example process or method 100 of operating a gaming system of the present disclosure to provide an example multi-hand card game with modifiers available based on the initially-dealt cards of the hands. In various embodiments, the process 100 is represented by a set of instructions stored in one or more memories and executed by one or more processors. Although the process 100 is described with reference to the flowchart shown in FIG. 1, many other processes of performing the acts associated with this illustrated process 100 may be employed. For example, the order of certain of the illustrated blocks or diamonds may be changed, certain of the illustrated blocks or diamonds may be optional, or certain of the illustrated blocks or diamonds may not be employed.

In operation of this example embodiment, the process 100 begins after the gaming system establishes a credit balance for a player (such as after an acceptor of the gaming system receives physical currency or a physical ticket associated with a monetary value). Responsive to an actuation of a wager button, the gaming system places a wager on and initiates a play of the card game, as block 102 indicates. The gaming system decreases the credit balance based on the wager, as block 104 indicates.

For each of a plurality of decks of cards (each of which includes a plurality of cards), the gaming system randomly selects a hand of a plurality of cards (such as five cards) from that deck, as block 106 indicates. For each hand, the gaming system displays a first subset of the cards of that hand (such as three cards) face-up and a second subset of the cards of that hand (such as two cards) face-down, as block 108 indicates. For each first subset, the gaming system associates a modifier with that first subset (or in certain embodiments the hand associated with that first subset) if a modifier triggering event occurred based on the face-up cards of that first subset, as block 110 indicates. For instance, in one embodiment the modifier triggering event occurs for a first subset when the face-up cards of the first subset form one of a plurality of designated card combinations.

As diamond 112 indicates, after associating any modifiers with the first subsets (or in certain embodiments the hands associated with the first subsets), the gaming system monitors for receipt of a first subset hold input that identifies which one of the first subsets of face-up cards the player desires to hold. After receiving the first subset hold input identifying one of the first subsets of face-up cards, the gaming system designates that first subset as a held first subset and discards the other non-held first subsets of face-up cards to create one or more incomplete hands, as block 114 indicates. The gaming system does not discard any modifiers associated with the discarded first subsets, and instead associates each of these modifiers with one of the incomplete hands.

As diamonds 116 and 120 indicate, after discarding the non-held first subsets of face-up cards, the gaming system monitors for receipt of a card hold input (or inputs) or a draw input. This enables the player to choose which cards of the held first subset of face-up cards (if any) to hold and which cards of the held first subset of face-up cards (if any) to discard. If at diamond 116 the gaming system determines that a card hold input identifying a particular card of the held first subset of face-up cards has been received, the gaming system designates that card as a held card, as block 118 indicates. The process 100 then proceeds to diamond 120. If at diamond 120 the gaming system determines that a draw input has not been received, the process 100 returns to diamond 116.

If the gaming system instead determines at diamond 120 that the draw input has been received, for each card of the held first subset of face-up cards that is not held, the gaming system randomly selects a replacement card and replaces that non-held card with that randomly-selected replacement card, as block 122 indicates. The gaming system then adds the current face-up cards of the held first subset (in this example embodiment, any of the first subset of face-up cards that were held and any replacement cards) to each incomplete hand, as block 124 indicates. At this point, all hands include the same face-up cards.

For each hand, the gaming system reveals the second subset of the cards of that hand, as block 126 indicates. For each hand that is one of a plurality of different winning hands, the gaming system determines any award for that hand, as block 128 indicates. If that hand is associated with a modifier, the gaming system determines any award based at least in part on the associated modifier. The gaming system displays and increases the credit balance based on any determined awards, as block 130 indicates. The play of the card game is complete following the award display.

As diamonds 132 and 134 indicate, after completing the play of the card game, the gaming system monitors for another actuation of the wager button or an actuation of a cashout button. If at diamond 132 the gaming system determines that another actuation of the wager button has been received, the process 100 returns to block 102 (assuming the credit balance is large enough to place another wager). If at diamond 134 the gaming system determines that an actuation of the cashout button has been received, the gaming system initiates a payout based on the credit balance (assuming a nonzero credit balance), as block 136 indicates, and the process 100 ends.

2. Example Gaming System Operation

FIGS. 2A to 2F illustrate screen shots of one example embodiment of a gaming system operating one example embodiment of a multi-hand card game with modifiers available based on the initially-dealt cards of the hands.

For a play of this example multi-hand card game, the gaming system:

(1) randomly selects 3 hands of 5 cards from 3 respective separate decks each including 52 conventional cards (though the decks may include any suitable cards or quantities of cards);

(2) for each hand, displays a first subset of 3 cards of that hand face-up and a second subset of 2 cards of that hand face-down (though the gaming system may display any suitable quantity of cards face-up and any suitable quantity of cards face-down);

(3) for each first subset, determines whether the 3 face-up cards of that first subset form one of the card combinations in Table 2 below, and if so associates the corresponding multiplier with that first subset;

(4) receives a first subset hold input from the player indicating which one of the 3 first subsets the player desires to hold;

(5) discards the 2 non-held first subsets;

(6) moves the held first subset and any associated multiplier to one of the other hands, thereby creating two incomplete hands;

(7) enables the player to hold or discard each face-up card of the held first subset;

(8) if any face-up cards of the held first subset are discarded, randomly selects a replacement card from the deck with which the first subset is not associated to replace that discarded card;

(9) post-replacement (if any), adds the cards of the held first subset to the two incomplete hands;

(10) reveals the second subset of 2 face-down cards of each hand; and

(11) for each hand, determines any award for that hand based on the cards of that hand and any associated multipliers.

TABLE 2

Example modifier triggering events

| Card Combination | Example | Multiplier |
|---|---|---|
| Straight Flush | 10♠ 9♠ 8♠ | 15× |
| Three of a Kind | Q♠ Q♥ Q♦ | 10× |
| Straight | 8♦ 7♣ 6♠ | 7× |
| Flush | A♠ J♠ 8♠ | 4× |
| Jacks or Better | K♦ K♠ 8♠ | 2× |

Thus, in this example embodiment, the modifier triggering event occurs for a first subset when the 3 face-up cards of that first subset form one of the plurality of different card combinations in Table 2. When the 3 face-up cards of a first subset form one of the card combinations in Table 2 (i.e., when the modifier triggering event occurs for that hand), the gaming system associates the multiplier that corresponds to that particular card combination with that first subset. For instance, the modifier triggering event occurs when the 3 initially-dealt face-up cards of a first subset of a hand are A♥, A♣ A♠. Accordingly, the gaming system associates the corresponding 10× multiplier with that first subset.

The gaming system displays a plurality of buttons actuatable via a touch screen including: (1) a SEE PAYS button 171, (2) a MORE GAMES button 172, (3) a SPEED button 173, (4) a BET DOWN button 174, (5) a BET UP button 175, (6) a DEAL button 176, and (7) a DRAW button 177. When the gaming system receives an actuation of the SEE PAYS button 171, if the paytable for the card game is not displayed, the gaming system displays the paytable, and if the paytable is displayed, the gaming system stops displaying the paytable. When the gaming system receives an actuation of the MORE GAMES button 172, the gaming system displays a menu of additional games the player can play via the gaming system. When the gaming system receives an actuation of the SPEED button 173, the gaming system increases or decreases the speed at which the gaming system displays plays of the card game. When the gaming system receives an actuation of the BET DOWN button 174, the gaming system reduces the player's wager by 1 credit per hand (or another suitable amount). When the gaming system receives an actuation of the BET UP button 175, the gaming system increases the player's wager by 1 credit per hand (or another suitable amount). When the gaming system receives an actuation of the DEAL button 176, the gaming system places a wager and initiates a play of the card game. When the gaming system receives an actuation of the DRAW button 177, the gaming system completes all hands, as described below.

The gaming system also displays a plurality of meters including: (1) a credit meter 181 that indicates the player's credit balance, (2) a wager meter 182 that displays the player's total wager for a play of the card game, and (3) an award meter 183 that displays any awards won for a play of the card game. While in this example embodiment the gaming system indicates the player's credit balance, the player's wager, and any awards in credits, the gaming system may also indicate them in amounts of currency.

Figure 2A:
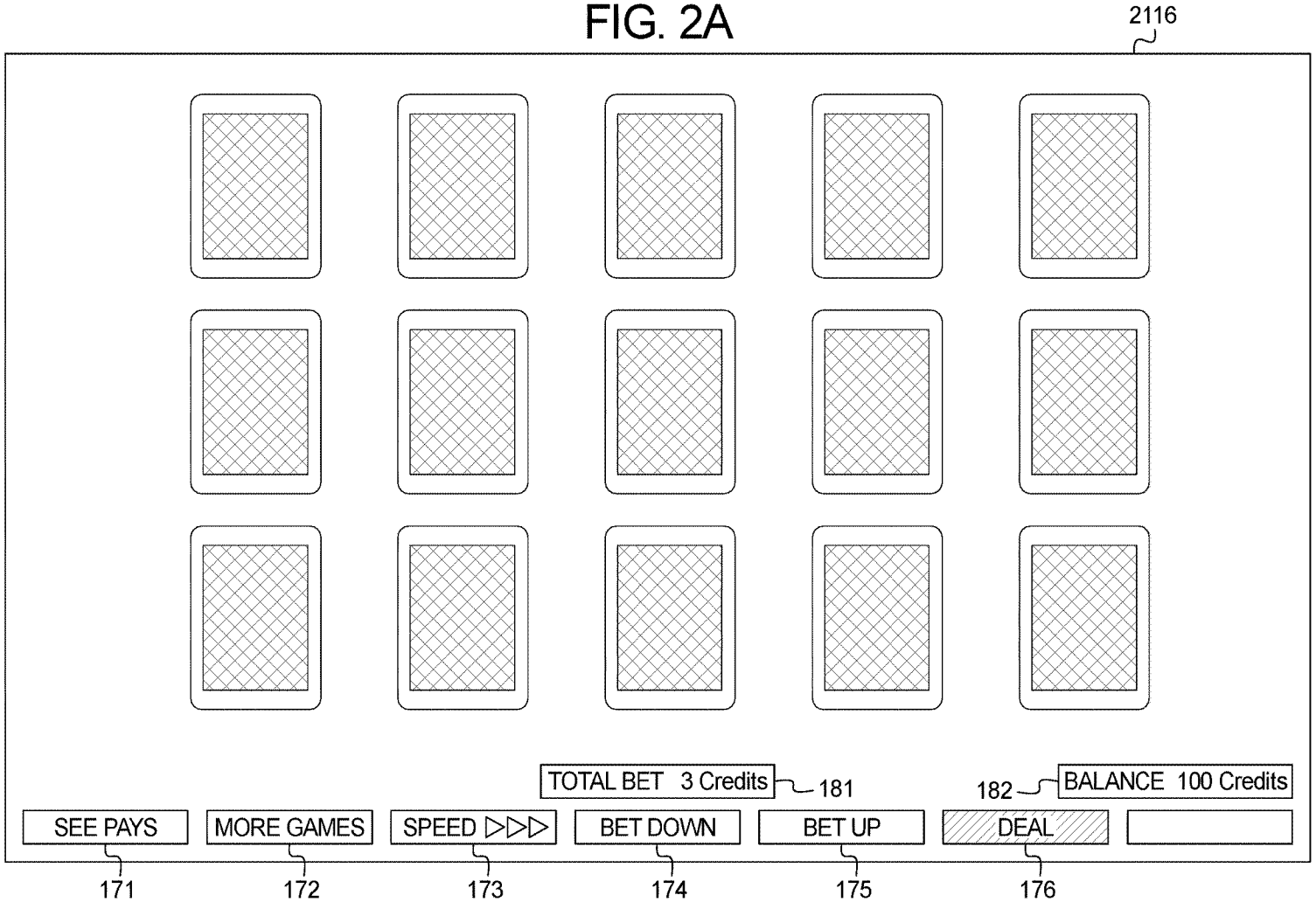
FIGS. 2A, 2B, 2C, 2D, 2E, and 2F illustrate screen shots of one example embodiment of a gaming system operating one example embodiment of a multi-hand card game with modifiers available based on the initially-dealt cards of the hands.

As illustrated in FIG. 2A, in this example embodiment, the gaming system receives value, such as physical currency (or its equivalent), via an acceptor. Here, the gaming system provides the player 100 credits, which represents the received value, and displays the player's credit balance of 100 credits in the credit meter 181. The gaming system receives an actuation of the DEAL button 176.

Figure 2B:
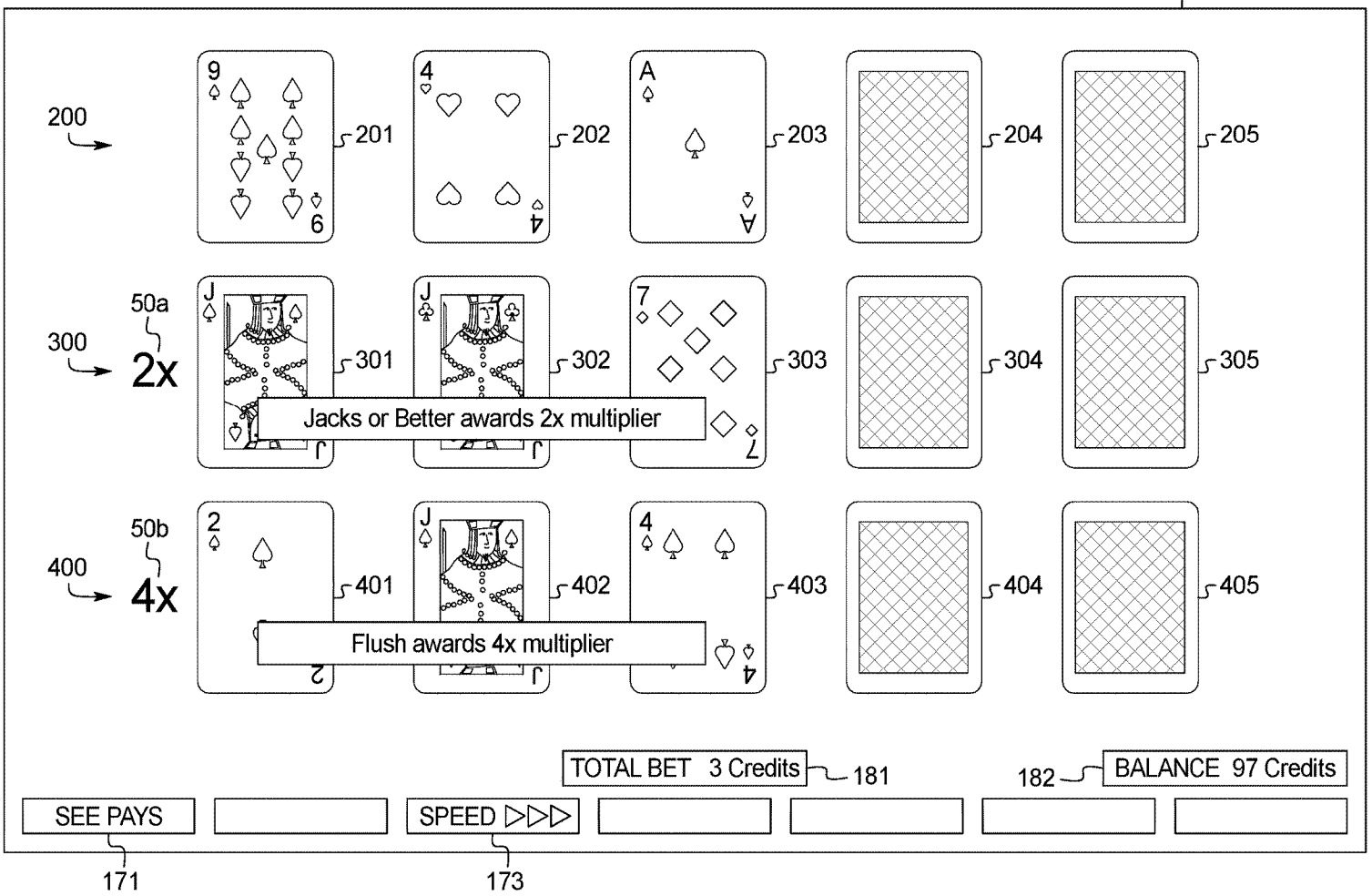

As illustrated in FIG. 2B, the gaming system places a 3 credit bet (1 credit per hand), decreases the credit balance by the 3 credit bet from 100 credits to 97 credits, and randomly selects: (1) a first hand 200 including cards 201 to 205 from a first deck of 52 different cards, (2) a second hand 300 including cards 301 to 305 from a separate second deck of 52 different cards, and (3) a third hand 400 including cards 401 to 405 from a separate third deck of 52 different cards. The gaming system displays: (1) a first subset of cards 9♠ 201, 4♥ 202, and A♠ 203 of the first hand 200 face-up and a second subset of cards 204 and 205 of the first hand 200 face-down; (2) a first subset of cards J♠ 301, J♣ 302, and 7♦ 303 of the second hand 300 face-up and a second subset of cards 304 and 305 of the second hand 300 face-down; and (3) a first subset of cards 2♠ 401, J♠ 402, and 4♠ 403 of the third hand 400 face-up and a second subset of cards 404 and 405 of the third hand 400 face-down.

At this point, the gaming system determines, for each first subset, whether the modifier triggering event occurred for that first subset. The gaming system does so in this example embodiment by determining, for each first subset, whether the first subset of 3 face-up cards form any of the card combinations in Table 2. Here, the gaming system: (1) determines that the first subset of face-up cards 9♠ 201, 4♥ 202, and A♠ 203 of the first hand 200 do not form any of the card combinations of Table 2 (i.e., that the modifier triggering event did not occur for the first subset of the first hand 200), and does not associate any multiplier with the first subset of the first hand 200; (2) determines that the first subset of face-up cards J♠ 301, J♣ 302, and 7♦ 303 of the second hand 300 form a Jacks or Better card combination (i.e., that the modifier triggering event occurred for the first subset of the second hand 300), and associates the corresponding 2× multiplier 50*a* with the first subset of the second hand 300; and (3) determines that the face-up cards 2♠ 401, J♠ 402, and 4♠ 403 of the third hand 400 form a Flush card combination (i.e., that the modifier triggering event occurred for the first subset of the third hand 400), and associates the corresponding 4× multiplier 50*b* with the first subset of the third hand 400.

Figure 2C:
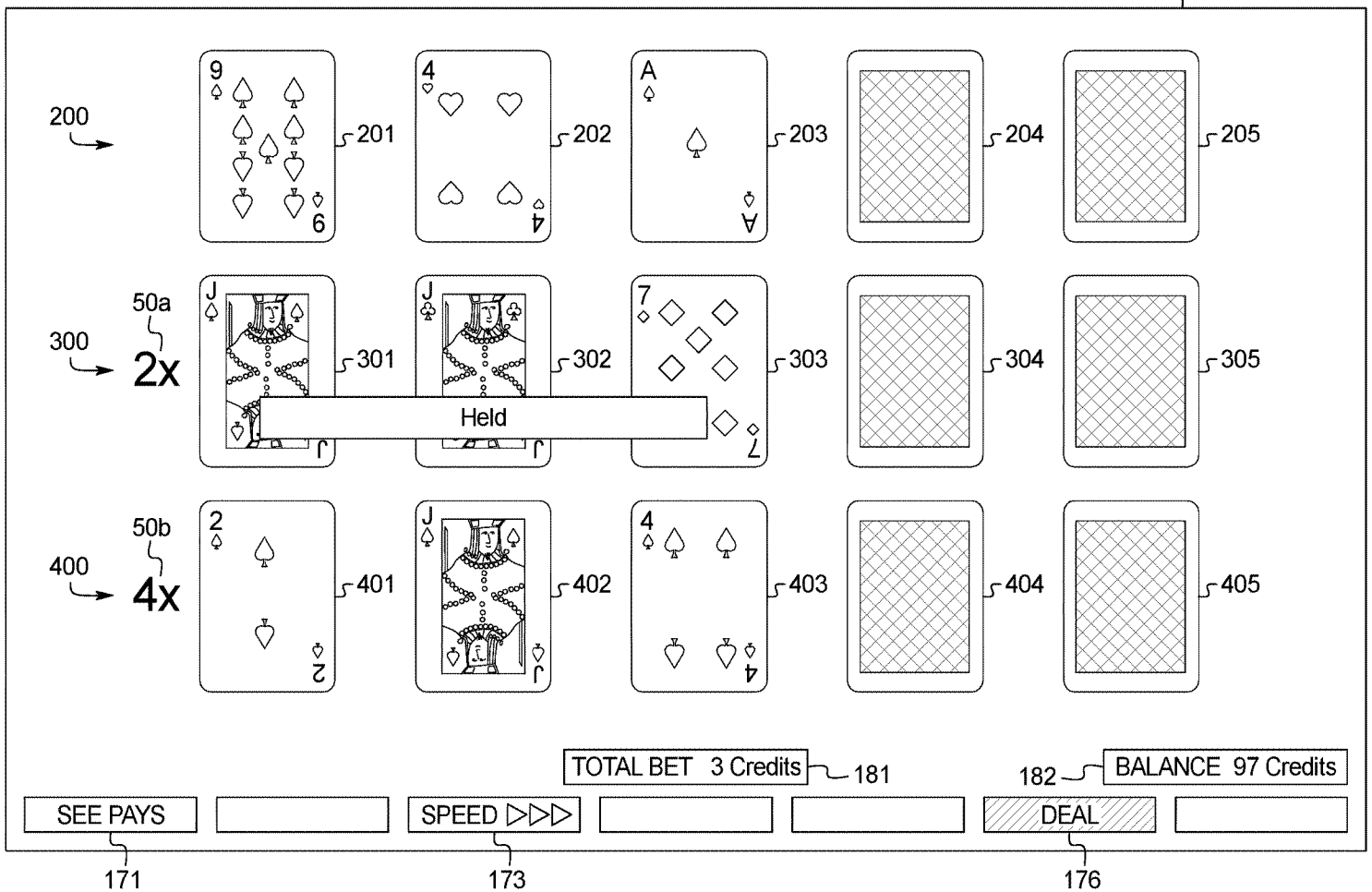

After associating any modifiers with the first subsets, in this example embodiment, the gaming system requires the player to select one of the 3 first subsets to hold. As described below, the gaming system discards the 2 non-held first subsets. As illustrated in FIG. 2C, the gaming system receives a selection of the first subset of the second hand 300 to hold along with an actuation of the DEAL button 176 to confirm the player's selection of the first subset of the second hand 300.

Figure 2D:
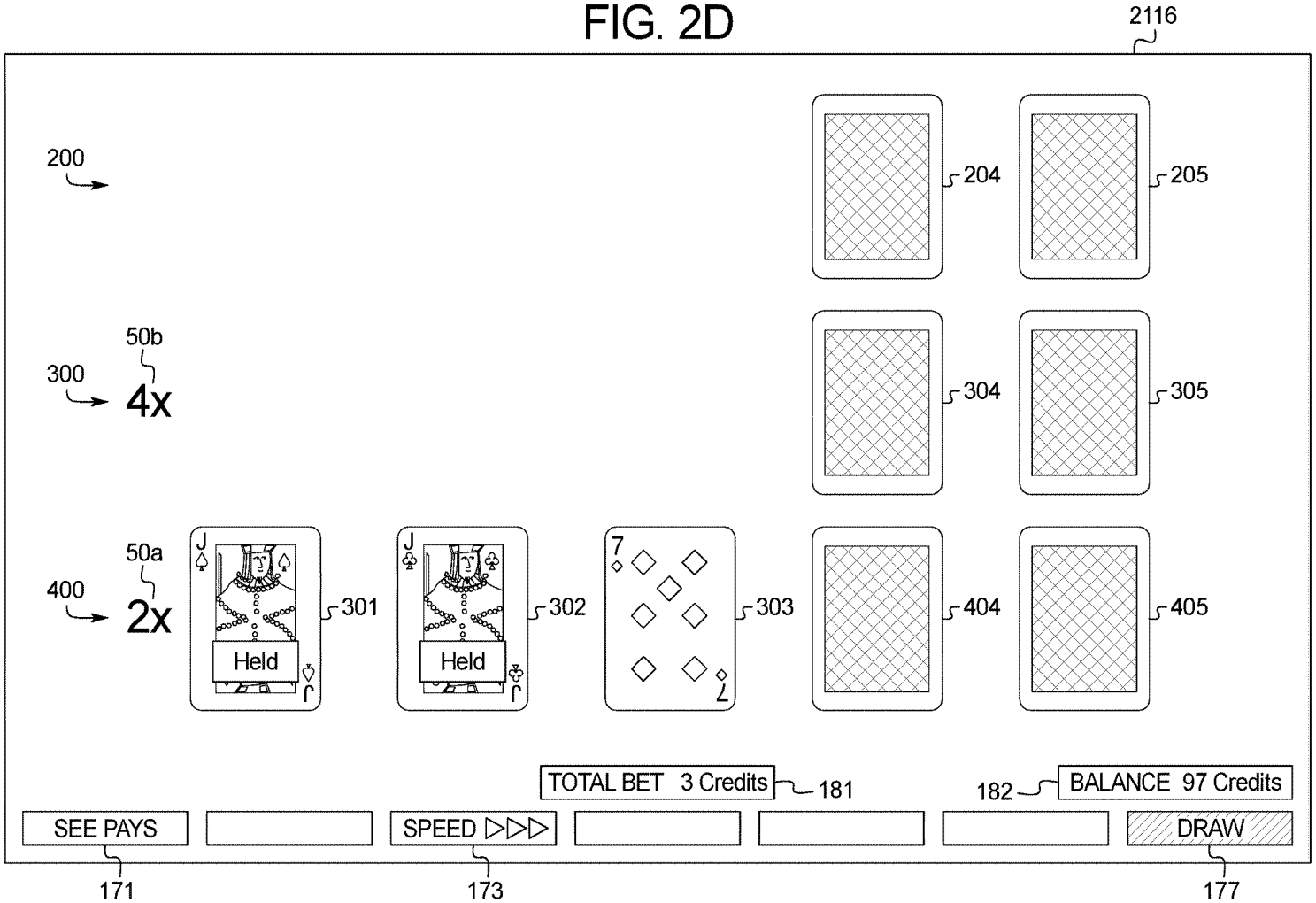

As illustrated in FIG. 2D, the gaming system discards the first subset face-up cards 9♠ 201, 4♥ 202, and A♠ 203 of the first hand 200 and the first subset of face-up cards 2♠ 401, J♠ 402, and 4♠ 403 of the third hand 400. The gaming system maintains the face-down cards 204 and 205 in the first hand 200 and maintains the face-down cards 404 and 405 in the third hand 400.

The gaming system also moves the first subset of face-up cards J♠ 301, J♣ 302, and 7♦ 303 and the associated 2× multiplier 50*a* from the second hand 300 to the third hand 400. The gaming system moves the 4× multiplier 50*b* formerly associated with the third hand 400 to the second hand 300. This creates two incomplete hands: the first and second hands 200 and 300. The gaming system may determine where to move the held first subset in any suitable manner, such as randomly, based on a predetermined pattern or rule, or based on player input. In other embodiments, the gaming system doesn't move the held first subset.

At this point, the gaming system enables the player to choose none of, one of, a plurality of but less than all of, or all of the face-up cards of the held first subset to hold. As described below, the gaming system discards any non-held face-up cards from the held first subset and replaces any discarded cards with replacement cards from the associated deck (here, the deck associated with the third hand 400). Here, the gaming system receives a selection of J♠ 301 and J♣ 302 of the held first subset to hold, and designates those cards as held cards. The gaming system receives an actuation of the DRAW button 177.

Figure 2E:
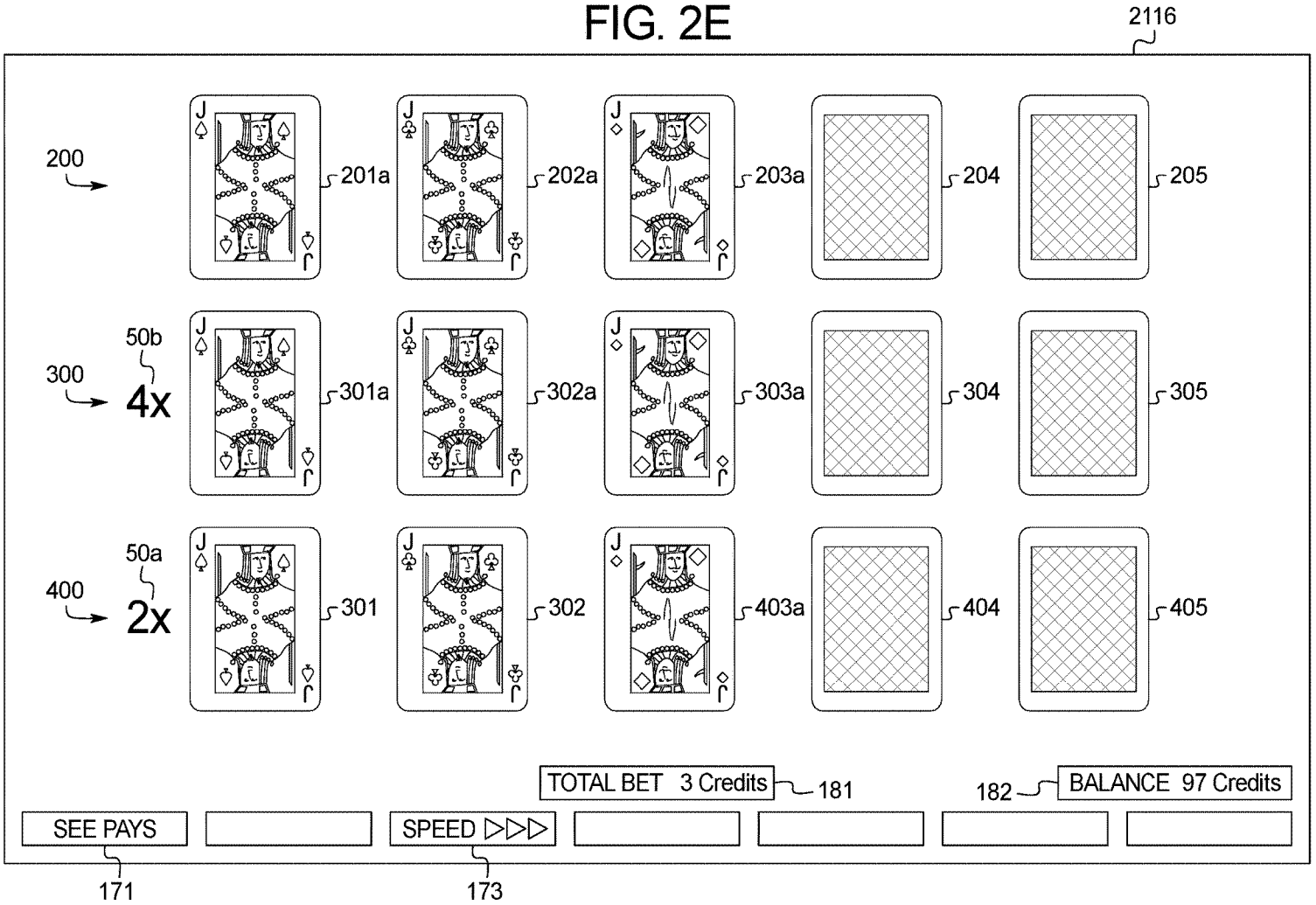

As illustrated in FIG. 2E, the gaming system randomly selects replacement card J♦ 403*a* from the deck associated with the third hand 400, and replaces the discarded (i.e., non-held) 7♦ 303 with this replacement card. The gaming system then adds duplicates of the face-up cards of the held first subset to the incomplete first and second hands 200 and 300 to complete those hands. Specifically, the gaming system adds: (1) cards J♠ 201*a*, J♣ 202*a*, and J♦ 203*a* to the first hand 200; and (2) cards J♠ 301*a*, J♣ 302*a*, and J♦ 303*a* to the second hand 300. The gaming system selects these duplicates from the hands' corresponding decks.

Figure 2F:
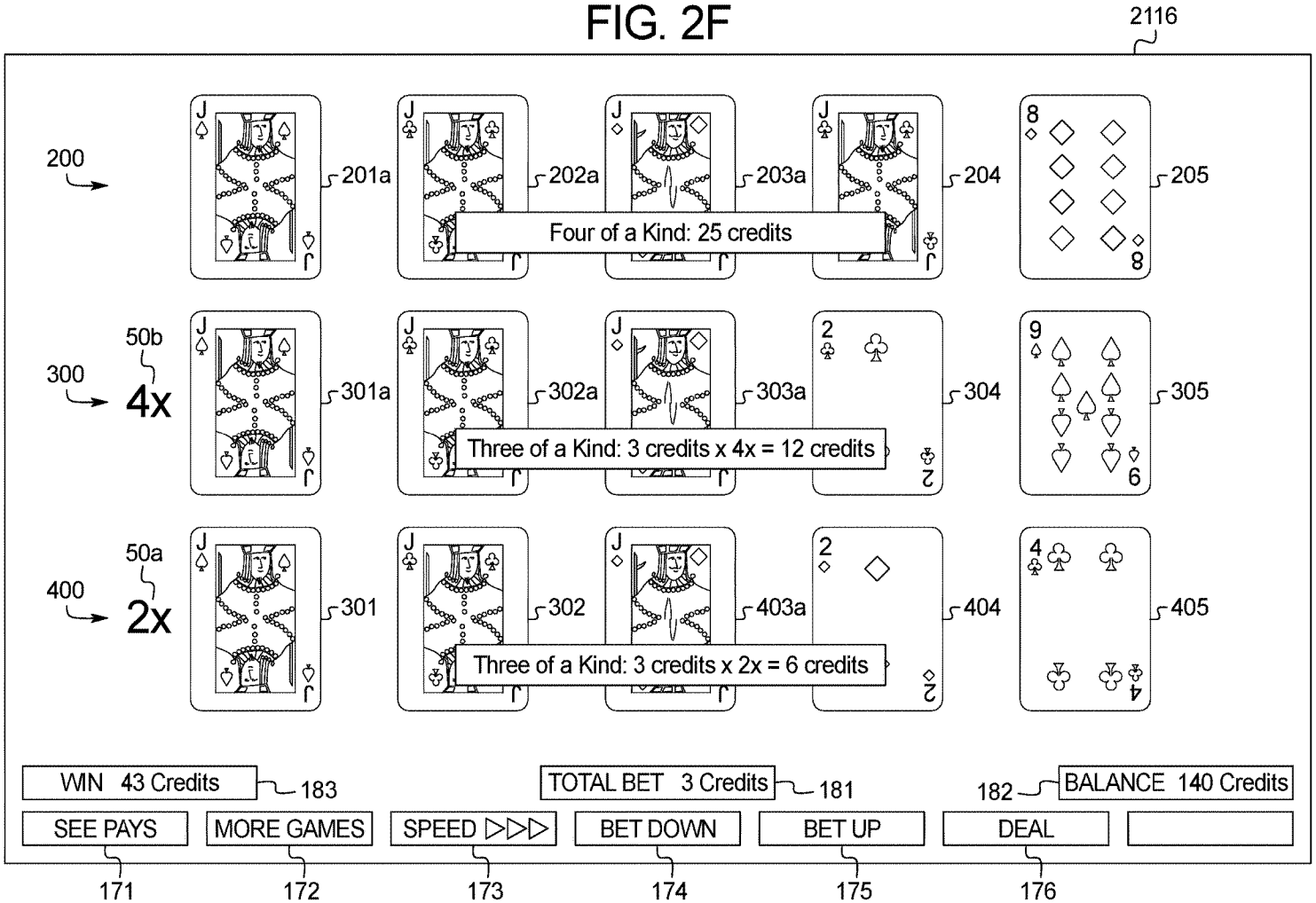

As illustrated in FIG. 2F, the gaming system then reveals the second subset of face-down cards of the first, second, and third hands 200, 300, and 400 and determines any award for each hand according to Table 3 below (though the gaming system may use any suitable paytable). Here, the gaming system reveals: (1) the J♣ 204 and 8♦ 205 of the first hand 200, (2) the 2♣ 304 and 9♠ 305 of the second hand 300, and (3) the 2♦ 404 and 4♣ 405 of the third hand 400. The gaming system determines that the first hand 200 forms a Four of a Kind and determines a corresponding 25 credit award. The gaming system determines that the second hand 300 forms a Three of a Kind and determines a corresponding 12 credit award (3 credits for the Three of a Kind multiplied by the associated 4× multiplier 50*b*). The gaming system determines that the second hand 400 forms a Three of a Kind and determines a corresponding 6 credit award (3 credits for the Three of a Kind multiplied by the associated 2× multiplier 50*a*). The gaming system increases the credit balance by the total award of 43 credits from 97 credits to 140 credits, and displays the 43 credit award in the award meter 183.

TABLE 3

Winning Hand Categories, Example Winning Hands, and Awards for Example Card Game

| Winning Hand Category | Example Winning Hand | Award (3 credit bet) |
|---|---|---|
| Five of a Kind | A♥ A♦ A♣ A♠ A♥ | 700 |
| Royal Flush | A♣ K♣ Q♣ J♣ 10♣ | 250 |
| Straight Flush | 10♣ 9♣ 8♣ 7♣ 6♣ | 50 |
| Four of a Kind | J♠ J♥ J♦ J♠3♣ | 25 |
| Full House | A♥ A♦ A♣ 6♦ 6♣ | 9 |
| Flush | A♣ J♣ 8♣ 6♣ 2♣ | 6 |
| Straight | 8♦ 7♣ 6♠ 5♠ 4♣ | 4 |

TABLE 3-continued

Winning Hand Categories, Example Winning Hands, and Awards for Example Card Game

| Winning Hand Category | Example Winning Hand | Award (3 credit bet) |
|---|---|---|
| Three of a Kind | Q♠ Q♥ Q♦ 6♦ 2♠ | 3 |
| Two Pair | 8♦ 8♥ 5♥ 5♣ 2♠ | 2 |
| Jacks or Better | K♦ K♠8♣ 7♣ 2♥ | 1 |

This example embodiment of the modifier feature improves gaming technology by providing a way for gaming establishment operators to increase player retention and profitability while improving player experience. The modifier feature incentivizes players to remain at EGMs and keep playing to attempt to trigger a modifier and reap the benefits. The modifier feature thus provides an anticipatory event that increases player enjoyment and induces them to remain at EGMs. Further, the game of this example embodiment adds another layer of player interaction in that the player chooses both a first subset of cards to hold and then the particular cards (if any) of that held first subset to hold. This further engages players by doubling the number of decisions the player must make during game play relative to conventional draw poker, thereby adding another level of strategy. This also incentivizes players to play more often to hone their skills so they can make the optimal decisions at both decision points and increase their ability to achieve an optimal average expected payback percentage. This increased player interaction and new anticipatory event solve the problem of player fatigue and boredom.

3. Variations

In certain embodiments, the modifier feature is only active for a play of a game if the gaming system receives an activation fee in addition to the wager on that play. For instance, if the modifier triggering event occurs for a particular first subset for a given play of the game but the gaming system did not receive the activation fee for that play, the gaming system does associate any modifier with that first subset. In other embodiments, the modifier feature is only active for players of a certain player tracking level or who have exceeded a certain player tracking level. In certain embodiments, the gaming system randomly determines whether to activate the modifier feature for a play of a game.

The game may be any suitable multi-hand card game in which one or more cards are dealt face-up and in which the modifier triggering event occurs based on the face-up card(s) of the first subsets. For instance, in one example embodiment, the card game is a multi-hand five card draw poker game in which the gaming system selects and displays face-up a plurality of initial hands of five cards. The five face-up cards of each hand form a first subset. In this example embodiment, the gaming system determines whether the modifier triggering event occurs for a particular initial hand based on the five face up cards of that initial hand. In another example embodiment, the card game is a multi-hand five card stud poker game without the ability to discard hands and/or cards (as in the example embodiment described in Section 2 above).

In certain embodiments, the modifier feature is applied to a reel-based game. One example reel-based game is associated with five reels. In this example embodiment, the gaming system initially hides two reels and spins and stops the remaining three. The gaming system determines whether to provide any modifiers based on the symbols on the three stopped reels. For instance, the gaming system may make this determination for each individual payline based on the symbols displayed along that payline. In another example, the gaming system may make this determination for all paylines based on all displayed symbols. The gaming system receives a selection of at least one of the three stopped reels to hold, and then re-spins any non-held reels and reveals the two hidden reels. The gaming system then makes an award determination based on the displayed symbols and any modifiers.

The game may be associated with any suitable quantity of one or more modifier triggering events. In certain embodiments, the occurrence of a modifier triggering event—regardless of which one—causes the gaming system to take the same action. For instance, in one example embodiment, a first modifier triggering event occurs for a first subset if the first subset includes A♠ and a second modifier triggering event occurs for a first subset if the first subset includes J♠ J♦. Regardless of whether the first or second modifier triggering event occurs, the gaming system associates a 3× multiplier with that first subset.

In other embodiments, the occurrence of different modifier triggering events causes the gaming system to take different actions. For instance, in one example embodiment, a first modifier triggering event occurs for a first subset if the first subset includes A♠ and a second modifier triggering event occurs for a first subset if the first subset includes J♠ J♦. If the first modifier triggering event occurs, the gaming system associates a 2× multiplier with that first subset, and if the second modifier triggering event occurs, the gaming system associates a 3× multiplier with that first subset.

In certain embodiments including a plurality of modifier triggering events, the rarer the modifier triggering event, the more valuable the modifier. For instance, as shown in Table 2 above, in one example embodiment multipliers increase as the modifier triggering event become less likely to occur.

In various embodiments, the occurrence of a collective modifier triggering event causes the gaming system to associate a modifier with each first subset. The collective modifier triggering event may be any suitable event, such as an event based on the cards of some or all of the first subsets. For instance, in one example embodiment the collective modifier triggering event occurs if the face-up cards of all first subsets, considered collectively, include cards forming a Royal Flush. In this example embodiment, the gaming system associates a 5× multiplier with each first subset when the collective modifier triggering event occurs. The gaming system may stack this modifier with other modifiers associated with the first subsets based on occurrences of modifier triggering events. For instance, if a first subset includes J♠ J♦ and the gaming system already associated a 3× multiplier with that first subset, the gaming system adds the 5× multiplier to the 3× multiplier to form an 8× multiplier associated with that first subset.

In other embodiments, the occurrence of a persistence triggering event causes the gaming system to carry over one or more modifiers to a next play of the card game. The persistence triggering event may be any suitable event, such as an event based on the cards of some or all of the finalized hands. For instance, in one example embodiment, if a finalized hand forms a Flush, the gaming system carries over any modifier associated with that finalized hand to the corresponding hand for the next play.

In certain embodiments, when the gaming system moves the held first subset after discarding the non-held first subsets, the gaming system does not move any modifier initially associated with the held first subset. Instead, the held first subset is associated with any modifier associated with the hand to which the gaming system moved the held first subset.

In various embodiments, after determining whether the modifier triggering event occurred for each first subset, the gaming combines any determined modifiers into a total modifier and associates the total modifier with each first subset. For instance, if the gaming system determines a 2× modifier associated with a first subset of a first hand, a 5× modifier associated with a first subset of a second hand, and a 3× modifier associated with a first subset of a third hand, the gaming system determines a total 10× modifier and associates the total 10× modifier with each first subset.

In further embodiments, after determining whether the modifier triggering event occurred for each first subset, the gaming system determines the largest modifier (if any) and associates that modifier with each first subset. For instance, if the gaming system determines a 2× modifier associated with a first subset of a first hand, a 5× modifier associated with a first subset of a second hand, and a 3× modifier associated with a first subset of a third hand, the gaming system associates the 5× modifier (i.e., the largest of the three modifiers) with each first subset.

In other embodiments, the gaming system enables the player to hold multiple first subsets rather than only one first subset.

In various embodiments, the gaming system does not move the held first subset.

In various embodiments, the modifier includes a monetary award (e.g., credits), a wheel spin, or a wild card.

The present disclosure contemplates that:

(a) the modifier triggering event(s);

(b) the modifier(s) associated with the modifier triggering event(s);

(c) the quantity of cards in the first subset;

(d) where the gaming system moves the held first subset; and/or (e) any other variables or determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an EGM; (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; or (26) determined in any other suitable manner or based on or independent of any other suitable factor(s).

4. Gaming Systems

The above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices.

Thus, in various embodiments, the gaming system of the present disclosure includes: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, the term "EGM" is used herein to refer to an electronic gaming machine (such as a slot machine, a video poker machine, a video lottery terminal (VLT), a video keno machine, or a video bingo machine located on a casino floor). Additionally, for brevity and clarity and unless specifically stated otherwise, "EGM" as used herein represents one EGM or a plurality of EGMs, "personal computing device" as used herein represents one personal computing device or a plurality of personal computing devices, and "central server, central controller, or remote host" as used herein represents one central server, central controller, or remote host or a plurality of central servers, central controllers, or remote hosts.

Figure 3:
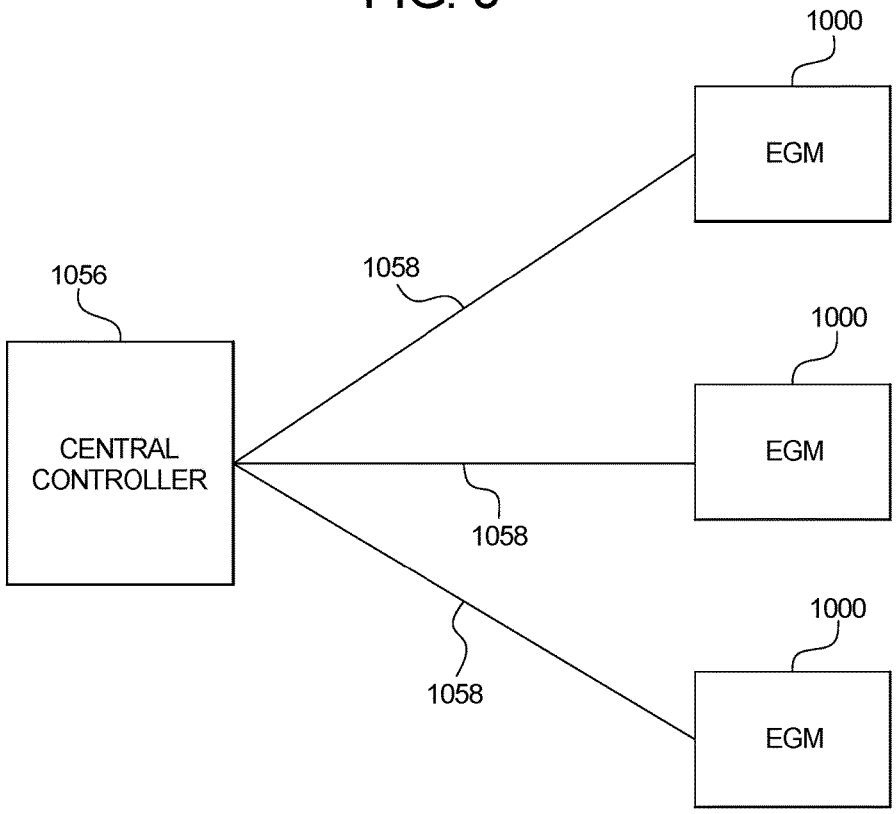
FIG. 3 is a schematic block diagram of one embodiment of a network configuration of the gaming system of the present disclosure.

As noted above, in various embodiments, the gaming system includes an EGM (or personal computing device) in combination with a central server, central controller, or remote host. In such embodiments, the EGM (or personal computing device) is configured to communicate with the central server, central controller, or remote host through a data network or remote communication link. In certain such embodiments, the EGM (or personal computing device) is configured to communicate with another EGM (or personal computing device) through the same data network or remote communication link or through a different data network or remote communication link. For example, the gaming system illustrated in FIG. 3 includes a plurality of EGMs 1000 that are each configured to communicate with a central server, central controller, or remote host 1056 through a data network 1058.

In certain embodiments in which the gaming system includes an EGM (or personal computing device) in combination with a central server, central controller, or remote host, the central server, central controller, or remote host is any suitable computing device (such as a server) that includes at least one processor and at least one memory device or data storage device. As further described herein, the EGM (or personal computing device) includes at least one EGM (or personal computing device) processor configured to transmit and receive data or signals representing events, messages, commands, or any other suitable information between the EGM (or personal computing device) and the central server, central controller, or remote host. The at least one processor of that EGM (or personal computing device) is configured to execute the events, messages, or commands represented by such data or signals in conjunction with the operation of the EGM (or personal computing device). Moreover, the at least one processor of the central server, central controller, or remote host is configured to transmit and receive data or signals representing events, messages, commands, or any other suitable information between the central server, central controller, or remote host and the EGM (or personal computing device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or personal computing device). Further, one, more than one, or each of the functions of the at least one processor of the EGM (or personal computing device) may be performed by the at least one processor of the central server, central controller, or remote host.

In certain such embodiments, computerized instructions for controlling any games (such as any primary or base games and/or any secondary or bonus games) displayed by the EGM (or personal computing device) are executed by the central server, central controller, or remote host. In such "thin client" embodiments, the central server, central controller, or remote host remotely controls any games (or other suitable interfaces) displayed by the EGM (or personal computing device), and the EGM (or personal computing device) is utilized to display such games (or suitable interfaces) and to receive one or more inputs or commands. In other such embodiments, computerized instructions for controlling any games displayed by the EGM (or personal computing device) are communicated from the central server, central controller, or remote host to the EGM (or personal computing device) and are stored in at least one memory device of the EGM (or personal computing device). In such "thick client" embodiments, the at least one processor of the EGM (or personal computing device) executes the computerized instructions to control any games (or other suitable interfaces) displayed by the EGM (or personal computing device).

In various embodiments in which the gaming system includes a plurality of EGMs (or personal computing devices), one or more of the EGMs (or personal computing devices) are thin client EGMs (or personal computing devices) and one or more of the EGMs (or personal computing devices) are thick client EGMs (or personal computing devices). In other embodiments in which the gaming system includes one or more EGMs (or personal computing devices), certain functions of one or more of the EGMs (or personal computing devices) are implemented in a thin client environment, and certain other functions of one or more of the EGMs (or personal computing devices) are implemented in a thick client environment. In one such embodiment in which the gaming system includes an EGM (or personal computing device) and a central server, central controller, or remote host, computerized instructions for controlling any primary or base games displayed by the EGM (or personal computing device) are communicated from the central server, central controller, or remote host to the EGM (or personal computing device) in a thick client configuration, and computerized instructions for controlling any secondary or bonus games or other functions displayed by the EGM (or personal computing device) are executed by the central server, central controller, or remote host in a thin client configuration.

In certain embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is a local area network (LAN) in which the EGMs (or personal computing devices) are located substantially proximate to one another and/or the central server, central controller, or remote host. In one example, the EGMs (or personal computing devices) and the central server, central controller, or remote host are located in a gaming establishment or a portion of a gaming establishment.

In other embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is a wide area network (WAN) in which one or more of the EGMs (or personal computing devices) are not necessarily located substantially proximate to another one of the EGMs (or personal computing devices) and/or the central server, central controller, or remote host. For example, one or more of the EGMs (or personal computing devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or personal computing devices) are located. In certain embodiments in which the data network is a WAN, the gaming system includes a central server, central controller, or remote host and an EGM (or personal computing device) each located in a different gaming establishment in a same geographic area, such as a same city or a same state. Gaming systems in which the data network is a WAN are substantially identical to gaming systems in which the data network is a LAN, though the quantity of EGMs (or personal computing devices) in such gaming systems may vary relative to one another.

In further embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is an internet (such as the Internet) or an intranet. In certain such embodiments, an Internet browser of the EGM (or personal computing device) is usable to access an Internet game page from any location where an Internet connection is available. In one such embodiment, after the EGM (or personal computing device) accesses the Internet game page, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. The central server, central controller, or remote host may, however, identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM (or personal computing device), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or personal computing device). Examples of implementations of Internet-based gaming are further described in U.S. Pat. No. 8,764,566, entitled "Internet Remote Game Server," and U.S. Pat. No. 8,147,334, entitled "Universal Game Server," which are incorporated herein by reference.

The central server, central controller, or remote host and the EGM (or personal computing device) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or personal computing devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

5. EGM Components

Figure 4:
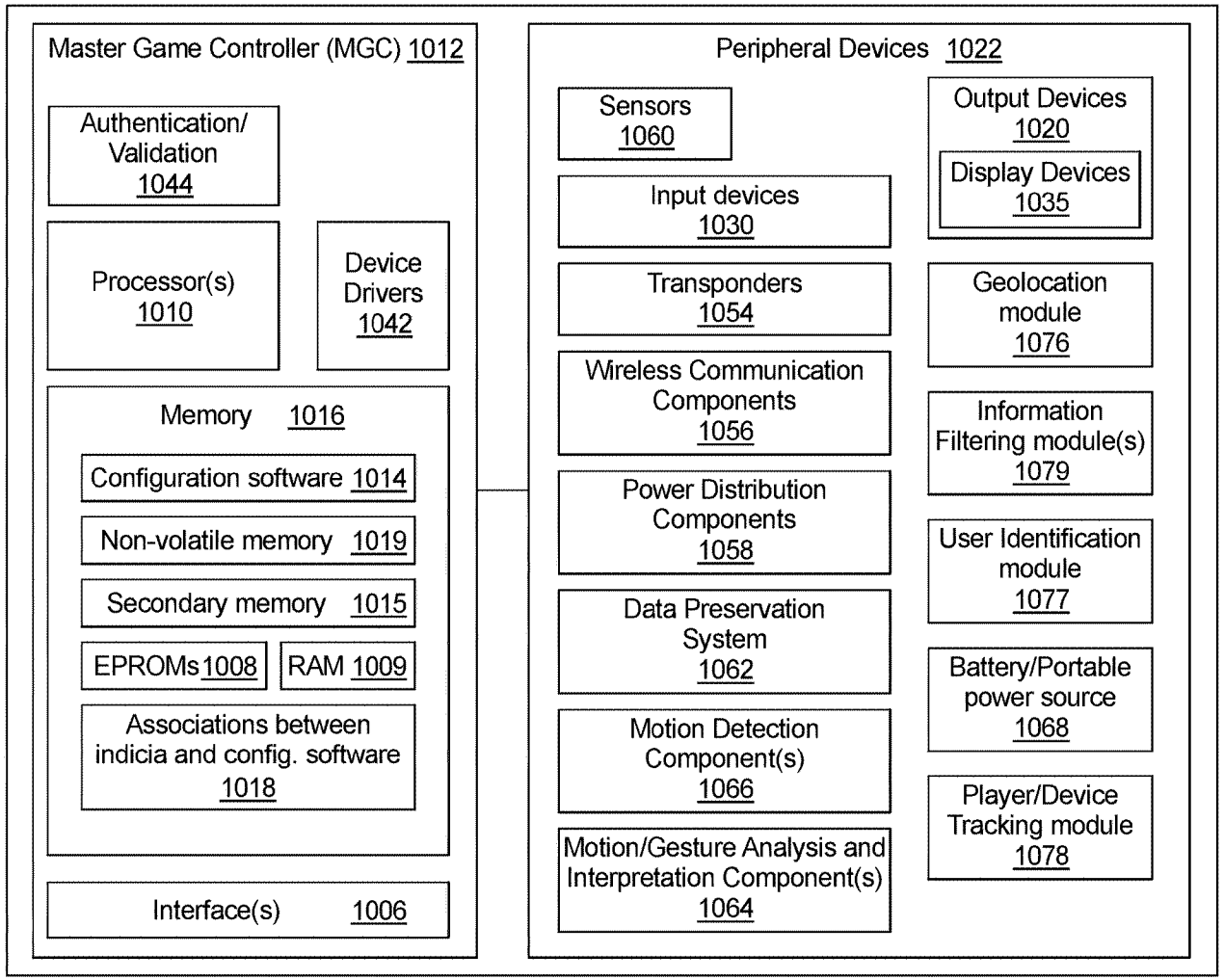
FIG. 4 is a schematic block diagram of an example electronic configuration of the gaming system of the present disclosure.
Figure 5A:
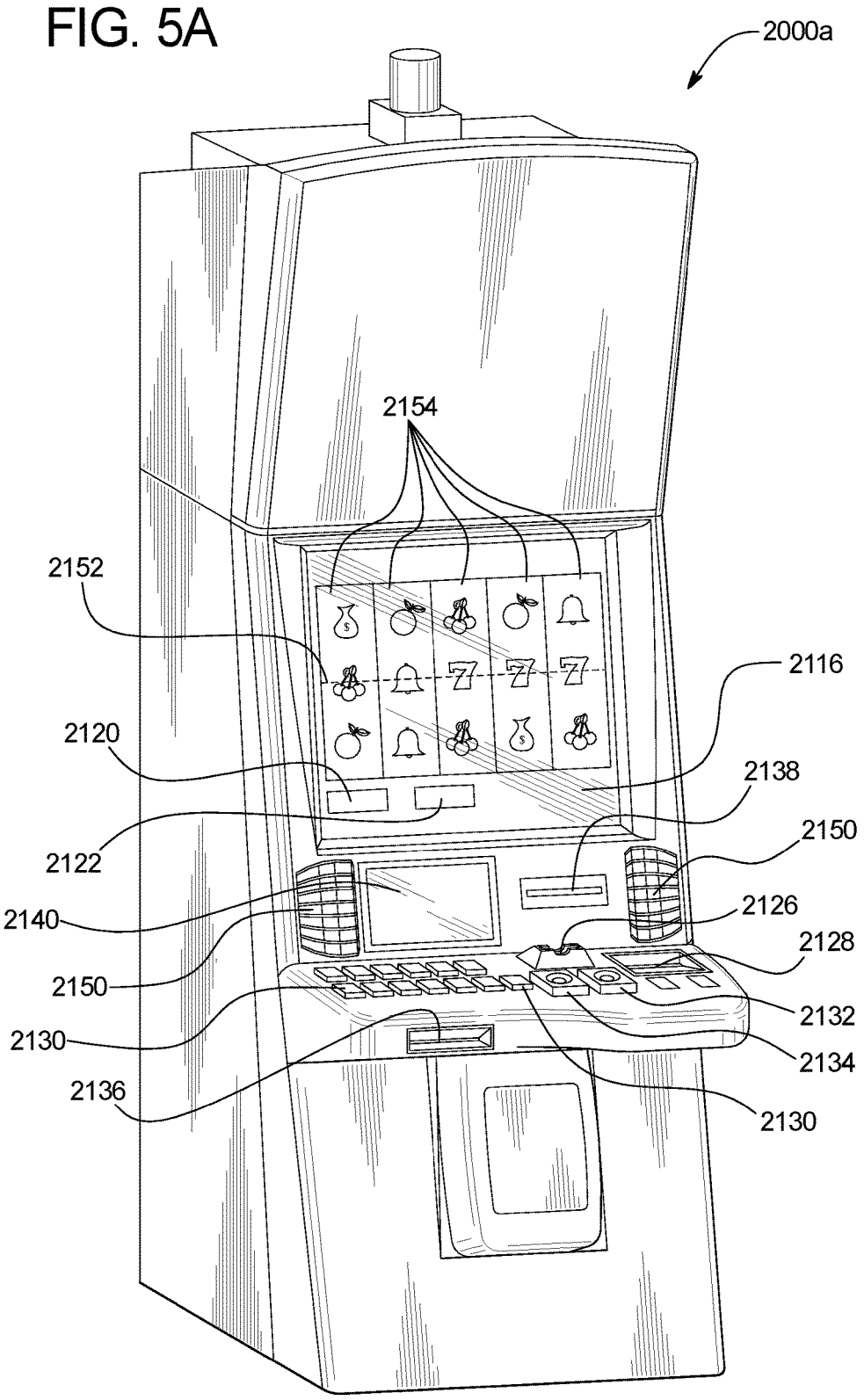
FIGS. 5A and 5B are perspective views of example alternative embodiments of the gaming system of the present disclosure.
Figure 5B:
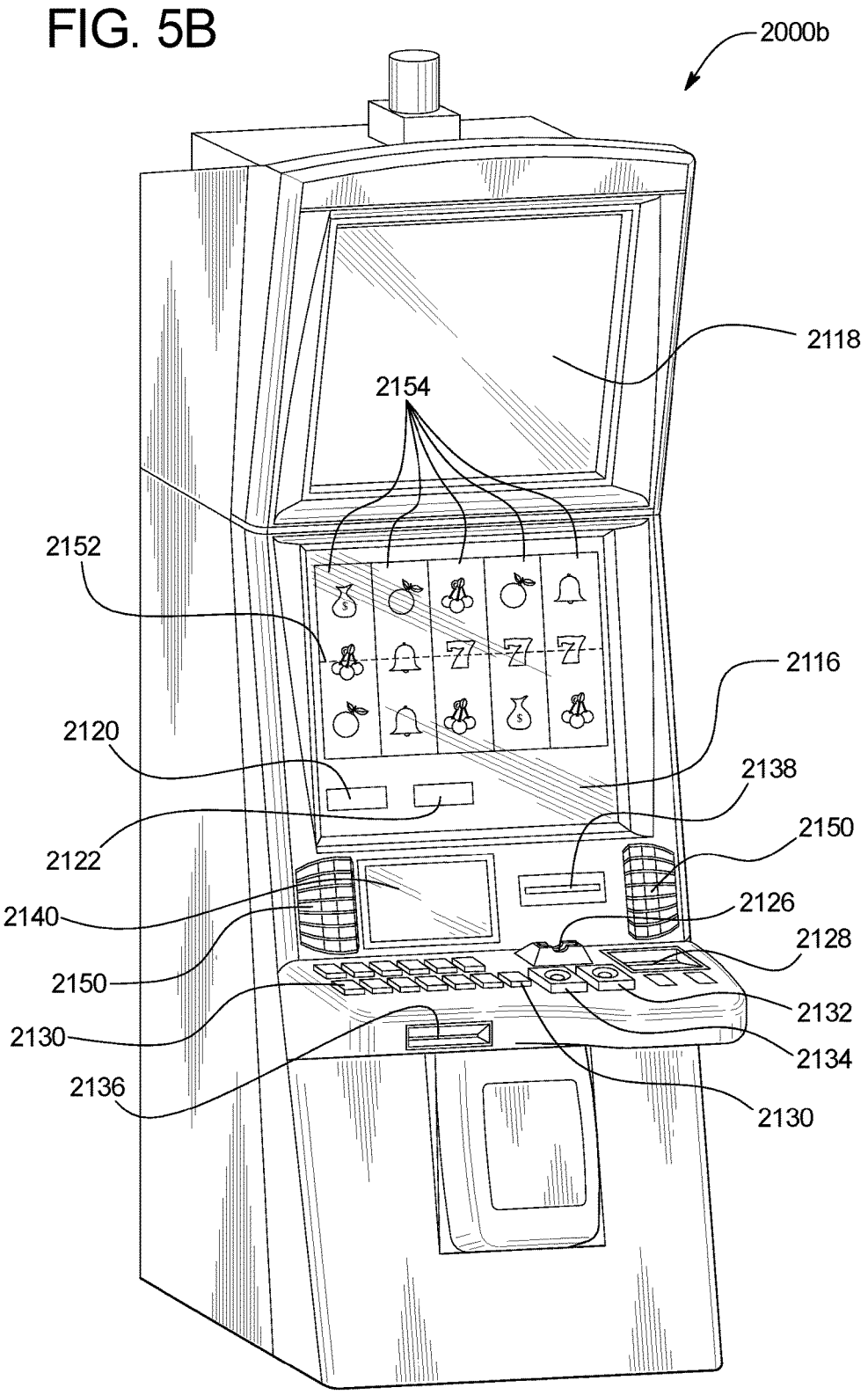

FIG. 4 is a block diagram of an example EGM 1000 and FIGS. 5A and 5B include two different example EGMs 2000*a* and 2000*b*. The EGMs 1000, 2000*a*, and 2000*b* are merely example EGMs, and different EGMs may be implemented using different combinations of the components shown in the EGMs 1000, 2000*a*, and 2000*b*.

In these embodiments, the EGM 1000 includes a master gaming controller 1012 configured to communicate with and to operate with a plurality of peripheral devices 1022.

The master gaming controller 1012 includes at least one processor 1010. The at least one processor 1010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface 1006 of the master gaming controller 1012; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices 1022 (such as input/output devices); and/or (5) controlling the peripheral devices 1022. In certain embodiments, one or more components of the master gaming controller 1012 (such as the at least one processor 1010) reside within a housing of the EGM (described below), while in other embodiments at least one component of the master gaming controller 1012 resides outside of the housing of the EGM.

The master gaming controller 1012 also includes at least one memory device 1016, which includes: (1) volatile memory (e.g., RAM 1009, which can include non-volatile RAM, magnetic RAM, ferroelectric RAM, and any other suitable forms); (2) non-volatile memory 1019 (e.g., disk memory, FLASH memory, EPROMs, EEPROMs, memristor-based non-volatile solid-state memory, etc.); (3) unalterable memory (e.g., EPROMs 1008); (4) read-only memory; and/or (5) a secondary memory storage device 1015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device 1016 resides within the housing of the EGM (described below), while in other embodiments at least one component of the at least one memory device 1016 resides outside of the housing of the EGM.

The at least one memory device 1016 is configured to store, for example: (1) configuration software 1014, such as all the parameters and settings for a game playable on the EGM; (2) associations 1018 between configuration indicia read from an EGM with one or more parameters and settings; (3) communication protocols configured to enable the at least one processor 1010 to communicate with the peripheral devices 1022; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller 1012 communicates with other devices using a serial communication protocol. A few non-limiting examples of serial communication protocols that other devices, such as peripherals (e.g., a bill validator or a ticket printer), may use to communicate with the master game controller 1012 include USB, RS-232, and Netplex (a proprietary protocol developed by IGT).

In certain embodiments, the at least one memory device 1016 is configured to store program code and instructions executable by the at least one processor of the EGM to control the EGM. The at least one memory device 1016 of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device 1016 also stores a plurality of device drivers 1042. Examples of different types of device drivers include device drivers for EGM components and device drivers for the peripheral components 1022. Typically, the device drivers 1042 utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device 1016 can be upgraded as needed. For instance, when the at least one memory device 1016 is a hard drive, new games, new game options, new parameters, new settings for existing parameters, new settings for new parameters, new device drivers, and new communication protocols can be uploaded to the at least one memory device 1016 from the master game controller 1012 or from some other external device. As another example, when the at least one memory device 1016 includes a CD/DVD drive including a CD/DVD configured to store game options, parameters, and settings, the software stored in the at least one memory device 1016 can be upgraded by replacing a first CD/DVD with a second CD/DVD. In yet another example, when the at least one memory device 1016 uses flash memory 1019 or EPROM 1008 units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In some embodiments, the at least one memory device 1016 also stores authentication and/or validation components 1044 configured to authenticate/validate specified EGM components and/or information, such as hardware components, software components, firmware components, peripheral device components, user input device components, information received from one or more user input devices, information stored in the at least one memory device 1016, etc. Examples of various authentication and/or validation components are described in U.S. Pat. No. 6,620,047, entitled "Electronic Gaming Apparatus Having Authentication Data Sets," which is incorporated herein by reference.

In certain embodiments, the peripheral devices 1022 include several device interfaces, such as: (1) at least one output device 1020 including at least one display device 1035; (2) at least one input device 1030 (which may include contact and/or non-contact interfaces); (3) at least one transponder 1054; (4) at least one wireless communication component 1056; (5) at least one wired/wireless power distribution component 1058; (6) at least one sensor 1060; (7) at least one data preservation component 1062; (8) at least one motion/gesture analysis and interpretation component 1064; (9) at least one motion detection component 1066; (10) at least one portable power source 1068; (11) at least one geolocation module 1076; (12) at least one user identification module 1077; (13) at least one player/device tracking module 1078; and (14) at least one information filtering module 1079.

The at least one output device 1020 includes at least one display device 1035 configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 2000*a* illustrated in FIG. 5A includes a central display device 2116, a player tracking display 2140, a credit display 2120, and a bet display 2122. The example EGM 2000*b* illustrated in FIG. 5B includes a central display device 2116, an upper display device 2118, a player tracking display 2140, a credit display 2120, and a bet display 2122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 1020 includes a payout device. In these embodiments, after the EGM receives an actuation of a cashout device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGMs 2000*a* and 2000*b* illustrated in FIGS. 5A and 5B each include a ticket printer and dispenser 2136. Examples of ticket-in ticket-out (TITO) technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; U.S. Pat. No. 6,729,958, entitled "Gaming System with Ticket-In/Ticket-Out Capability"; U.S. Pat. No. 6,736,725, entitled "Gaming Method and Host Computer with Ticket-In/Ticket-Out Capability"; U.S. Pat. No. 7,275,991, entitled "Slot Machine with Ticket-In/Ticket-Out Capability"; U.S. Pat. No. 6,048,269, entitled "Coinless Slot Machine System and Method"; and U.S. Pat. No. 5,290,003, entitled "Gaming Machine and Coupons," which are incorporated herein by reference.

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine," which is incorporated herein by reference.

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device 1020 is a sound generating device controlled by one or more sound cards. In one such embodiment, the sound generating device includes one or more speakers or other sound generating hardware and/or software configured to generate sounds, such as by playing music for any games or by playing music for other modes of the EGM, such as an attract mode. The example EGMs 2000*a* and 2000*b* illustrated in FIGS. 5A and 5B each include a plurality of speakers 2150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device 1030 may include any suitable device that enables an input signal to be produced and received by the at least one processor 1010 of the EGM.

In one embodiment, the at least one input device 1030 includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGMs 2000*a* and 2000*b* illustrated in FIGS. 5A and 5B each include a combined bill and ticket acceptor 2128 and a coin slot 2126.

In one embodiment, the at least one input device 1030 includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine," which is incorporated herein by reference. When the EGM is funded, the at least one processor determines the amount of funds entered and displays the corresponding amount on a credit display or any other suitable display as described below.

In certain embodiments, the at least one input device 1030 includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 1030 includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. The example EGMs 2000*a* and 2000*b* illustrated in FIGS. 5A and 5B each include a game play activation device in the form of a game play initiation button 2132. In other embodiments, the EGM begins game play automatically upon appropriate funding rather than upon utilization of the game play activation device.

In other embodiments, the at least one input device 1030 includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance. The example EGMs 2000*a* and 2000*b* illustrated in FIGS. 5A and 5B each include a cashout device in the form of a cashout button 2134.

In various embodiments, the at least one input device 1030 includes a plurality of buttons that are programmable by the EGM operator to, when actuated, cause the EGM to perform particular functions. For instance, such buttons may be hard keys, programmable soft keys, or icons icon displayed on a display device of the EGM (described below) that are actuatable via a touch screen of the EGM (described below) or via use of a suitable input device of the EGM (such as a mouse or a joystick). The example EGMs 2000*a* and 2000*b* illustrated in FIGS. 5A and 5B each include a plurality of such buttons 2130.

In certain embodiments, the at least one input device 1030 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device 1030 includes a card reader in communication with the at least one processor of the EGM. The example EGMs 2000*a* and 2000*b* illustrated in FIGS. 5A and 5B each include a card reader 2138. The card reader is configured to read a player identification card inserted into the card reader.

The at least one wireless communication component 1056 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component 1058 includes components or devices that are configured to provide power to other devices. For example, in one embodiment, the at least one power distribution component 1058 includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component 1058 is configured to distribute power to one or more internal components of the EGM, such as one or more rechargeable power sources (e.g., rechargeable batteries) located at the EGM.

In certain embodiments, the at least one sensor 1060 includes at least one of: optical sensors, pressure sensors, RF sensors, infrared sensors, image sensors, thermal sensors, and biometric sensors. The at least one sensor 1060 may be used for a variety of functions, such as: detecting movements and/or gestures of various objects within a predetermined proximity to the EGM; detecting the presence and/or identity of various persons (e.g., players, casino employees, etc.), devices (e.g., user input devices), and/or systems within a predetermined proximity to the EGM.

The at least one data preservation component 1062 is configured to detect or sense one or more events and/or conditions that, for example, may result in damage to the EGM and/or that may result in loss of information associated with the EGM. Additionally, the data preservation system 1062 may be operable to initiate one or more appropriate action(s) in response to the detection of such events/conditions.

The at least one motion/gesture analysis and interpretation component 1064 is configured to analyze and/or interpret information relating to detected player movements and/or gestures to determine appropriate player input information relating to the detected player movements and/or gestures. For example, in one embodiment, the at least one motion/gesture analysis and interpretation component 1064 is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source 1068 enables the EGM to operate in a mobile environment. For example, in one embodiment, the EGM 300 includes one or more rechargeable batteries.

The at least one geolocation module 1076 is configured to acquire geolocation information from one or more remote sources and use the acquired geolocation information to determine information relating to a relative and/or absolute position of the EGM. For example, in one implementation, the at least one geolocation module 1076 is configured to receive GPS signal information for use in determining the position or location of the EGM. In another implementation, the at least one geolocation module 1076 is configured to receive multiple wireless signals from multiple remote devices (e.g., EGMs, servers, wireless access points, etc.) and use the signal information to compute position/location information relating to the position or location of the EGM.

The at least one user identification module 1077 is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module 1079 is configured to perform filtering (e.g., based on specified criteria) of selected information to be displayed at one or more displays 1035 of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

As generally described above, in certain embodiments, such as the example EGMs 2000*a* and 2000*b* illustrated in FIGS. 5A and 5B, the EGM has a support structure, housing, or cabinet that provides support for a plurality of the input devices and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 2000*a* and 2000*b* shown in FIGS. 5A and 5B, EGMs may have varying housing and display configurations.

In certain embodiments, the EGM is a device that has obtained approval from a regulatory gaming commission, and in other embodiments, the EGM is a device that has not obtained approval from a regulatory gaming commission.

The EGMs described above are merely three examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

6. Operation of Primary or Base Games and/or Secondary or Bonus Games

In various embodiments, an EGM may be implemented in one of a variety of different configurations. In various embodiments, the EGM may be implemented as one of: (a) a dedicated EGM in which computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. Examples of this type of award evaluation are described in U.S. Pat. No. 7,470,183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game," which are incorporated herein by reference.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat. No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern," which are incorporated herein by reference.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services," which are incorporated herein by reference.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM 2000*b* shown in FIG. 5B includes a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations," which are incorporated herein by reference.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. Examples of progressive gaming systems are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards," which are incorporated herein by reference As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game (s). The secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. Any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win," which are incorporated herein by reference.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a mobile phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services," which are incorporated herein by reference.

7. Differentiating Certain Gaming Systems from General Purpose Computing Devices Certain of the gaming systems described herein, such as EGMs located in a casino or another gaming establishment, include certain components and/or are configured to operate in certain manners that differentiate these systems from general purpose computing devices, i.e., certain personal gaming devices such as desktop computers and laptop computers.

For instance, EGMs are highly regulated to ensure fairness and, in many cases, EGMs are configured to award monetary awards up to multiple millions of dollars. To satisfy security and regulatory requirements in a gaming environment, hardware and/or software architectures are implemented in EGMs that differ significantly from those of general purpose computing devices. For purposes of illustration, a description of EGMs relative to general purpose computing devices and some examples of these additional (or different) hardware and/or software architectures found in EGMs are described below.

At first glance, one might think that adapting general purpose computing device technologies to the gaming industry and EGMs would be a simple proposition because both general purpose computing devices and EGMs employ processors that control a variety of devices. However, due to at least: (1) the regulatory requirements placed on EGMs, (2) the harsh environment in which EGMs operate, (3) security requirements, and (4) fault tolerance requirements, adapting general purpose computing device technologies to EGMs can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an EGM because in an EGM these faults can lead to a direct loss of funds from the EGM, such as stolen cash or loss of revenue when the EGM is not operating properly or when the random outcome determination is manipulated.

Certain differences between general purpose computing devices and EGMs are described below. A first difference between EGMs and general purpose computing devices is that EGMs are state-based systems. A state-based system stores and maintains its current state in a non-volatile memory such that, in the event of a power failure or other malfunction, the state-based system can return to that state when the power is restored or the malfunction is remedied. For instance, for a state-based EGM, if the EGM displays an award for a game of chance but the power to the EGM fails before the EGM provides the award to the player, the EGM stores the pre-power failure state in a non-volatile memory, returns to that state upon restoration of power, and provides the award to the player. This requirement affects the software and hardware design on EGMs. General purpose computing devices are not state-based machines, and a majority of data is usually lost when a malfunction occurs on a general purpose computing device.

A second difference between EGMs and general purpose computing devices is that, for regulatory purposes, the software on the EGM utilized to operate the EGM has been designed to be static and monolithic to prevent cheating by the operator of the EGM. For instance, one solution that has been employed in the gaming industry to prevent cheating and to satisfy regulatory requirements has been to manufacture an EGM that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the EGM in the presence of a gaming regulator. Regardless of whether the EPROM solution is used, to gain approval in most gaming jurisdictions, an EGM must demonstrate sufficient safeguards that prevent an operator or a player of an EGM from manipulating the EGM's hardware and software in a manner that gives him an unfair, and in some cases illegal, advantage.

A third difference between EGMs and general purpose computing devices is authentication—EGMs storing code are configured to authenticate the code to determine if the code is unaltered before executing the code. If the code has been altered, the EGM prevents the code from being executed. The code authentication requirements in the gaming industry affect both hardware and software designs on EGMs. Certain EGMs use hash functions to authenticate code. For instance, one EGM stores game program code, a hash function, and an authentication hash (which may be encrypted). Before executing the game program code, the EGM hashes the game program code using the hash function to obtain a result hash and compares the result hash to the authentication hash. If the result hash matches the authentication hash, the EGM determines that the game program code is valid and executes the game program code. If the result hash does not match the authentication hash, the EGM determines that the game program code has been altered (i.e., may have been tampered with) and prevents execution of the game program code. Examples of EGM code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes," which are incorporated herein by reference.

A fourth difference between EGMs and general purpose computing devices is that EGMs have unique peripheral device requirements that differ from those of a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an EGM have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain EGMs use a watchdog timer to provide a software failure detection mechanism. In a normally-operating EGM, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain EGMs use several power supply voltages to operate portions of the computer circuitry. These can be generated in a central power supply or locally on the computer board. If any of these voltages falls out of the tolerance limits of the circuitry they power, unpredictable operation of the EGM may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain EGMs have power supplies with relatively tighter voltage margins than that required by the operating circuitry. In addition, the voltage monitoring circuitry implemented in certain EGMs typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the EGM.

As described above, certain EGMs are state-based machines. Different functions of the game provided by the EGM (e.g., bet, play, result, points in the graphical presentation, etc.) may be defined as a state. When the EGM moves a game from one state to another, the EGM stores critical data regarding the game software in a custom non-volatile memory subsystem. This ensures that the player's wager and credits are preserved and to minimize potential disputes in the event of a malfunction on the EGM. In general, the EGM does not advance from a first state to a second state until critical information that enables the first state to be reconstructed has been stored. This feature enables the EGM to recover operation to the current state of play in the event of a malfunction, loss of power, etc. that occurred just prior to the malfunction. In at least one embodiment, the EGM is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the EGM memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve EGM critical data, although other types of non-volatile memory devices may be employed. These memory devices are typically not used in typical general purpose computing devices.

Thus, in at least one embodiment, the EGM is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of EGM critical information) within a time period of 200 milliseconds or less. In at least one embodiment, the time period of 200 milliseconds represents a maximum amount of time for which sufficient power may be available to the various EGM components after a power outage event has occurred at the EGM.

As described previously, the EGM may not advance from a first state to a second state until critical information that enables the first state to be reconstructed has been atomically stored. After the state of the EGM is restored during the play of a game of chance, game play may resume and the game may be completed in a manner that is no different than if the malfunction had not occurred. Thus, for example, when a malfunction occurs during a game of chance, the EGM may be restored to a state in the game of chance just prior to when the malfunction occurred. The restored state may include metering information and graphical information that was displayed on the EGM in the state prior to the malfunction. For example, when the malfunction occurs during the play of a card game after the cards have been dealt, the EGM may be restored with the cards that were previously displayed as part of the card game. As another example, a bonus game may be triggered during the play of a game of chance in which a player is required to make a number of selections on a video display screen. When a malfunction has occurred after the player has made one or more selections, the EGM may be restored to a state that shows the graphical presentation just prior to the malfunction including an indication of selections that have already been made by the player. In general, the EGM may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the EGM and the state of the EGM (e.g., credits) at the time the game of chance was played. The game history information may be utilized in the event of a dispute. For example, a player may decide that in a previous game of chance that they did not receive credit for an award that they believed they won. The game history information may be used to reconstruct the state of the EGM prior to, during, and/or after the disputed game to demonstrate whether the player was correct or not in her assertion. Examples of a state-based EGM, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play," which are incorporated herein by reference.

Another feature of EGMs is that they often include unique interfaces, including serial interfaces, to connect to specific subsystems internal and external to the EGM. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the EGM, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between EGMs. As another example, SAS is a communication protocol used to transmit information, such as metering information, from an EGM to a remote device. Often SAS is used in conjunction with a player tracking system.

Certain EGMs may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an EGM by monitoring security switches attached to access doors in the EGM cabinet. Access violations result in suspension of game play and can trigger additional security operations to preserve the current state of game play. These circuits also function when power is off by use of a battery backup. In power-off operation, these circuits continue to monitor the access doors of the EGM. When power is restored, the EGM can determine whether any security violations occurred while power was off, e.g., via software for reading status registers. This can trigger event log entries and further data authentication operations by the EGM software.

Trusted memory devices and/or trusted memory sources are included in an EGM to ensure the authenticity of the software that may be stored on less secure memory subsystems, such as mass storage devices. Trusted memory devices and controlling circuitry are typically designed to not enable modification of the code and data stored in the memory device while the memory device is installed in the EGM. The code and data stored in these devices may include authentication algorithms, random number generators, authentication keys, operating system kernels, etc. The purpose of these trusted memory devices is to provide gaming regulatory authorities a root trusted authority within the computing environment of the EGM that can be tracked and verified as original. This may be accomplished via removal of the trusted memory device from the EGM computer and verification of the secure memory device contents is a separate third party verification device. Once the trusted memory device is verified as authentic, and based on the approval of the verification algorithms included in the trusted device, the EGM is enabled to verify the authenticity of additional code and data that may be located in the gaming computer assembly, such as code and data stored on hard disk drives. Examples of trusted memory devices are described in U.S. Pat. No. 6,685,567, entitled "Process Verification," which is incorporated herein by reference.

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment," which is incorporated herein by reference.

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, EGMs that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System," which is incorporated herein by reference.

Various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A gaming system comprising:

a processor; and a memory device that stores instructions that, when executed by the processor, cause the processor to:

randomly determine a plurality of initial hands of cards;

for each initial hand:

cause a display of a first subset of cards of that initial hand face-up on a display device and cause a display of a second subset of cards of that initial hand face-down on the display device;

determine whether a modifier triggering event occurred for that initial hand based on the first subset of cards of that initial hand; and responsive to an occurrence of the modifier triggering event for that initial hand, associate a modifier with that initial hand;

for the plurality of initial hands of cards:

responsive to receipt, by an input device, of a selection to hold one of the first subsets of cards, discard the remaining non-held first subsets of cards;

for the held first subset of cards:

responsive to receipt, by the input device, of a selection to hold any of the cards from that held first subset of cards, discard each non-held card from that held first subset of cards and randomly select a replacement card for each non-held card of that held first subset of cards to form a complete held first subset of cards; and duplicate the complete held first subset of cards in each of the other hands of cards;

reveal the second subset of cards for each of the hands of cards to form a plurality of finalized hands of cards;

for each finalized hand, determine any award for that finalized hand based at least in part on any modifier associated with that finalized hand; and cause a display of any awards on the display device.

2. The gaming system of claim 1, wherein the instructions, when executed by the processor, cause the processor to, for each initial hand, finalize that initial hand at least in part by causing the second subset of cards of that initial hand to be revealed on the display device.

3. The gaming system of claim 1, wherein the instructions, when executed by the processor, cause the processor to randomly determine the initial hands from respective separate decks of cards.

4. The gaming system of claim 1, wherein for one of the initial hands, the modifier triggering event occurs for that initial hand when the first subset of cards of that initial hand form a designated combination of cards.

5. The gaming system of claim 1, wherein the instructions, when executed by the processor, cause the processor to, for each initial hand, associate a first modifier with that initial hand if the first subset of cards of that initial hand form a first designated combination of cards and a second different modifier with that initial hand if the first subset of cards of that initial hand form a second different designated combination of cards.

6. The gaming system of claim 5, wherein the first and second modifiers are multipliers, the first multiplier is greater than the second multiplier, and a probability of occurrence of the first designated combination of cards is less than a probability of occurrence of the second designated combination of cards.

7. The gaming system of claim 1, further comprising the display device, an input device, and an acceptor configured to receive a physical item associated with a monetary value, and wherein the instructions, when executed by the processor, cause the processor to:

establish a credit balance responsive to receipt of the physical item by the acceptor;

place a wager responsive to receipt of a wager input and cause the credit balance to decrease based on the wager;

determine any awards for the finalized hands based at least in part on the wager;

cause the credit balance to increase based on any awards; and initiate a payout responsive to receipt of a cashout input.

8. A method of operating a gaming system, the method comprising:

randomly determining, by a processor, a plurality of initial hands of cards;

for each initial hand:

causing, by the processor, a display of a first subset of cards of that initial hand face-up on a display device and causing, by the processor, a display of a second subset of cards of that initial hand face-down on the display device;

determining, by the processor, whether a modifier triggering event occurred for that initial hand based on the first subset of cards of that initial hand; and responsive to an occurrence of the modifier triggering event for that initial hand, associating, by the processor, a modifier with that initial hand;

for the plurality of initial hands of cards:

responsive to receiving, by an input device, a selection to hold one of the first subsets of cards, discarding the remaining non-held first subsets of cards;

for the held first subset of cards:

responsive to receiving, by the input device, a selection to hold any of the cards from that held first subset of cards, discarding each non-held card from that held first subset of cards and randomly selecting a replacement card for each non-held card of that held first subset of cards to form a complete first subset of cards; and duplicating, by the processor, the complete held first subset of cards in each of the other hands of cards;

revealing, by the processor, the second subset of cards for each of the hands of cards to form a plurality of finalized hands of cards;

for each finalized hand, determining, by the processor, any award for that finalized hand based at least in part on any modifier associated with that finalized hand; and causing, by the processor, a display of any awards on the display device.

9. The method of claim 8, further comprising finalizing, by the processor and for each initial hand, that initial hand at least in part by causing the second subset of cards of that initial hand to be revealed on the display device.

10. The method of claim 8, further comprising randomly determining, by the processor, the initial hands from respective separate decks of cards.

11. The method of claim 8, wherein for one of the initial hands, the modifier triggering event occurs for that initial hand when the first subset of cards of that initial hand form a designated combination of cards.

12. The method of claim 8, further comprising associating, by the processor and for each initial hand, a first modifier with that initial hand if the first subset of cards of that initial hand form a first designated combination of cards and a second different modifier with that initial hand if the first subset of cards of that initial hand form a second different designated combination of cards.

13. The method of claim 12, wherein the first and second modifiers are multipliers, the first multiplier is greater than the second multiplier, and a probability of occurrence of the first designated combination of cards is less than a probability of occurrence of the second designated combination of cards.

14. The method of claim 8, further comprising:

receiving, by an acceptor, a physical item associated with a monetary value;

establishing, by the processor, a credit balance responsive to receipt of the physical item by the acceptor;

receiving, by an input device, a wager input;

placing, by the processor, a wager responsive to receipt of the wager input and causing, by the processor, the credit balance to decrease based on the wager;

determining, by the processor, any awards for the finalized hands based at least in part on the wager;

causing, by the processor, the credit balance to increase based on any awards; and initiating, by the processor, a payout responsive to receipt of a cashout input.

* * * * *